US006272710B1

(12) United States Patent
Prough

(10) Patent No.: US 6,272,710 B1
(45) Date of Patent: Aug. 14, 2001

(54) PLATE DIFFUSER FOR TREATING COMMINUTED CELLULOSIC FIBROUS MATERIAL

(76) Inventor: James R. Prough, 22 Ferndell Spring Dr., Saratoga Springs, NY (US) 12866

( * ) Notice: Subject to any disclaimer, the term of this patent is extended or adjusted under 35 U.S.C. 154(b) by 0 days.

(21) Appl. No.: 09/306,416

(22) Filed: May 6, 1999

Related U.S. Application Data

(60) Provisional application No. 60/084,666, filed on May 7, 1998.

(51) Int. Cl.[7] ..... D06B 3/02

(52) U.S. Cl. ..... 8/156; 68/181 R; 68/18 F; 162/60; 162/251

(58) Field of Search ..... 68/18 F, 181 R; 162/232, 60, 38, 251; 210/323.2

(56) References Cited

U.S. PATENT DOCUMENTS

| | | | |
|---|---|---|---|
| 439,033 | * | 10/1890 | Forbes . |
| 2,539,991 | * | 1/1951 | Chapman . |
| 3,348,390 | | 10/1967 | Richter . |
| 3,372,087 | | 3/1968 | Richter . |
| 3,524,551 | | 8/1970 | Richter . |
| 3,563,891 | | 2/1971 | Richter . |
| 3,760,948 | | 9/1973 | Johansen . |
| 3,807,202 | * | 4/1974 | Gunkel . |
| 4,029,579 | | 6/1977 | Jacobsen et al. . |
| 4,041,560 | | 8/1977 | Jacobsen . |
| 4,076,623 | | 2/1978 | Golston . |
| 4,100,069 | | 7/1978 | Sherman . |
| 4,172,037 | | 10/1979 | Golston . |
| 4,276,167 | | 6/1981 | Richter et al. . |
| 4,368,628 | | 1/1983 | Jacobsen . |
| 4,375,410 | | 3/1983 | Richter et al. . |
| 4,394,267 | | 7/1983 | Richter et al. . |
| 4,396,509 | | 8/1983 | Foyn . |
| 4,441,224 | | 4/1984 | Laakso . |
| 4,529,482 | | 7/1985 | Richter et al. . |
| 4,535,497 | | 8/1985 | Jacobsen . |
| 4,556,494 | | 12/1985 | Richter et al. . |

(List continued on next page.)

*Primary Examiner*—Frankie L. Stinson
(74) *Attorney, Agent, or Firm*—Robert A. Vanderhye

(57) ABSTRACT

The problems of non-uniform treatment of paper pulp that may be caused by differential flow velocities within a vessel, channeling, and/or disruption of the pulp flow, are substantially eliminated by providing a non-circular cross-section substantially atmospheric pressure vessel with at least one screen surface, and typically a liquid introducing device. The vessel, screen surface, and liquid introducing device are constructed and positioned with respect to each other so that during the treatment of a pulp slurry the slurry has substantially uniform width in a treatment zone, and there is substantially uniform resistance to the flow of slurry over the screen surface over any particular cross-section of the vessel in the treatment zone, and its consistency varies less than 6% in the treatment zone (e.g. between 8–14%). The screen surface may comprise substantially vertical screening portions vertically spaced by non-screening portions, and the vessel wall may bulge out at the location of the non-screening portions so as to provide a slurry width at the bulges at least five percent wider than at the screening portions. The vessel may have a substantially race track shape in cross-section at the treatment zone, and the slurry width may form an annulus in the vessel, the annulus being substantially uninterrupted in the treatment zone (there being no arms or like structures which disrupt the flow). The screen surface may be rotated 5–30°, or oscillated or vibrated horizontally (transverse to pulp movement) to minimize plugging.

31 Claims, 13 Drawing Sheets

U.S. PATENT DOCUMENTS

| | | | |
|---|---|---|---|
| 4,637,878 | * | 1/1987 | Richter et al. . |
| 4,750,454 | * | 6/1988 | Santina et al. . |
| 4,793,161 | | 12/1988 | Richter et al. . |
| 4,840,047 | | 6/1989 | Richter et al. . |
| 4,881,286 | | 11/1989 | Richter et al. . |
| 4,908,896 | | 3/1990 | Jacobsen et al. . |
| 4,944,167 | | 7/1990 | Jacobsen et al. . |
| 4,971,694 | | 11/1990 | Richter . |
| 4,975,148 | * | 12/1990 | Ryham . |
| 5,027,620 | | 7/1991 | Richter . |
| 5,560,229 | | 10/1996 | Jonsson et al. . |
| 5,567,262 | * | 10/1996 | Phillips et al. . |
| 5,567,279 | | 10/1996 | Phillips et al. . |
| 5,779,890 | * | 7/1998 | Bailey . |
| 5,836,181 | | 11/1998 | Jonsson et al. . |

* cited by examiner

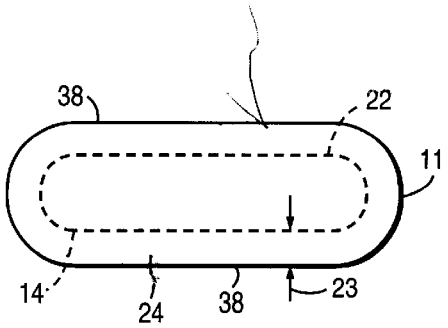
Fig. 3
Fig. 1
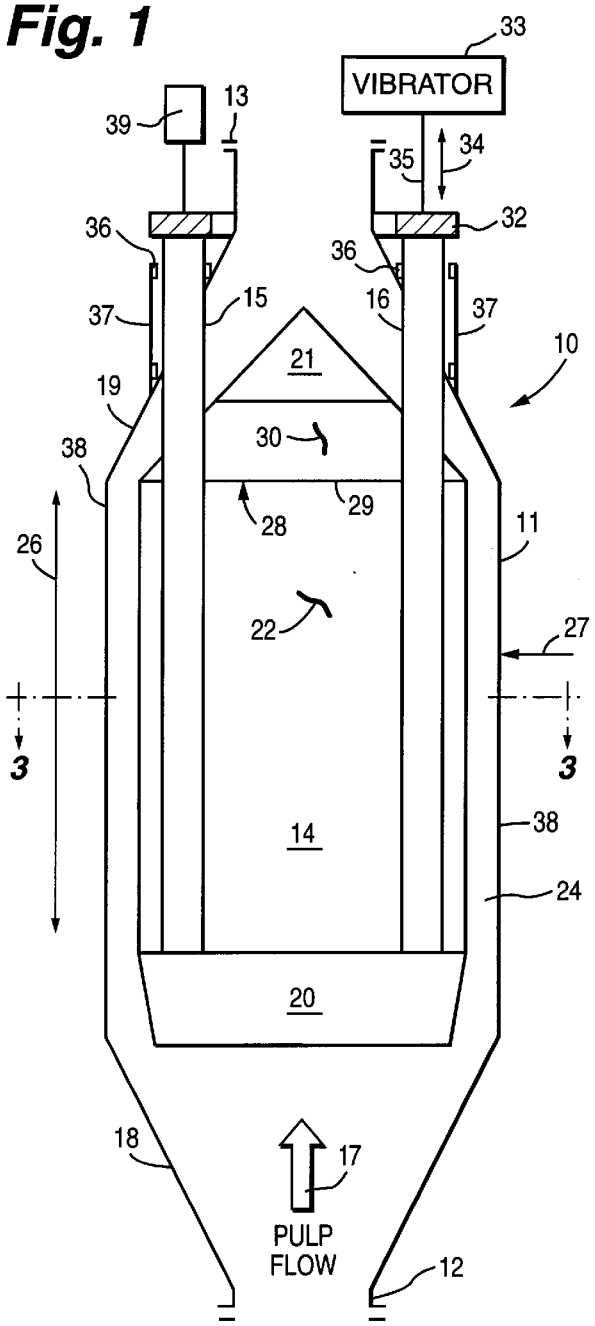
Fig. 2
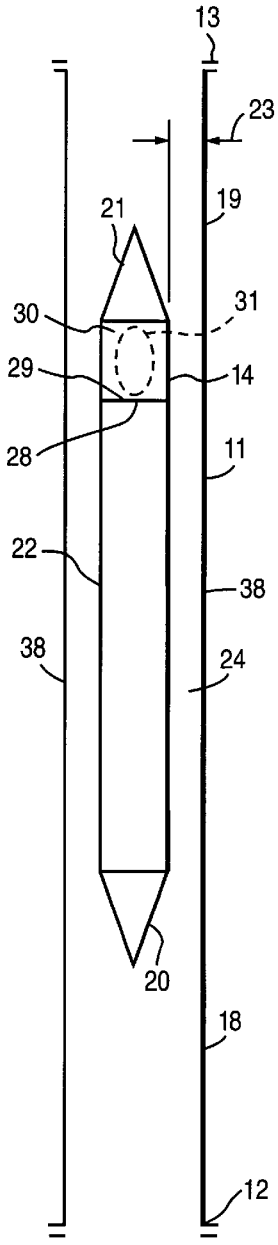

SCREEN ASSEMBLY
PULP FLOW
PULP FLOW
210
82
83
86
87
85
84
119
133
170
160
159
81
110'
140
117
118
8 measured
calculated
$c^{max}$
$c^{min}$
$10 \times 10^4$ N/m$^2$
Δp
0
1
2
3
4
5
6
7
8
9
0
0.50
1.00
$1.59 \times 10^{-3}$
LIQUID VELOCITY, m/s $v = 1.85 \times 10^{-3}$ m/s
1.50
1.30
1.07
0.75
0.25
c
250
kg/m$^3$
200
150
100
50
0
nozzle
screen
0
0.050
0.100
0.150
0.200
DISTANCE m

PLATE DIFFUSER FOR TREATING COMMINUTED CELLULOSIC FIBROUS MATERIAL

CROSS-REFERENCE TO RELATED APPLICATION

This application is based upon U.S. provisional application Ser. No. 60/084,666 filed May 7, 1998.

BACKGROUND AND SUMMARY OF THE INVENTION

Diffusion washing of comminuted cellulosic fibrous material has been practiced since the 1960s in large cylindrical vessels containing reciprocating screen assemblies. One prominent design is built and marketed by Ahistrom Machinery Inc. of Glens Falls, N.Y. under the name Atmospheric Diffusion Washer. These screen assemblies, referred to as "diffusers", typically comprise spaced concentric rings with perforated screen plates on the internal and external surfaces of the rings. Treatment liquids are typically distributed by rotating arms with upward or downward pointing distribution nozzles. Typical conventional designs are shown in U.S. Pat. Nos. 5,183,536 and 5,116,476.

This concentric ring design is not new, but was a characteristic of the very first diffuser designs. Examples of these early designs are shown n U.S. Pat. Nos. 3,348,390; 3,524,551; 3,563,891; and 3,760,948. Ostensibly, this circular ring design appears to be a preferred geometry for the diffusion of wash or bleaching liquids through a bed of medium consistency (i.e. about 8–15%) wood pulp. The circular rings provide not only an aesthetically pleasing, symmetric appearance but also appear to provide the optimum diffusion of treatment fluid through an upwardly flowing medium consistency bed of cellulosic material, e.g., wood pulp. The annular spaces between the rings form uniform pulp beds to which treatment medium can be applied and then extracted through the adjacent screens. The efficacy of this design has been confirmed by the hundreds of diffusers sold, and still being sold, since the 1970s. The Ahlstrom Atmospheric Diffuison washer is recognized today as one of the leading technologies in medium consistency pulp treatment.

However, regardless of the technological and commercial success of these devices there are some shortcomings of the concentric ring design that have shown this design to be less than optimum. For example, the concentric ring design produces a non-uniform resistance to the upward flow of pulp. The vertical screen plates of a typical diffuser design produce friction between the screen plates and the pulp flowing past it. This resistance to flow is directly proportional to the area of the screen over which the pulp flows. Since the area of screen to which each annular pulp bed is exposed increases as the diameter of each ring increases, the resistance to pulp flow is greater in the outer pulp annuli than in the inner annuli. In practice, this phenomenon is seen as a faster pulp flow in the inner annuli than in the outer annuli. This gradient in pulp velocity produces non-uniform treatment of pulp, or, in extreme cases, "channeling" of faster flowing pulp passed regions of slower moving pulp.

Another drawback of the present circular diffuser designs is the disruption of the pulp bed by the support structure of the rings. In all conventional diffuser designs the concentric rings are supported by some form of radial arms or beams which support the rings and provide part of the means for reciprocating the assembly. (Conventional diffusers are reciprocated to wipe the screen plates clean and prevent pluggage of the screen plates.) Several different non-circular configurations are illustrated in U.S. Pat. No. 4,276,167, but these designs all employ some form of radial or transverse support arms which traverse the pulp bed. However, these radial arms traverse the pulp flow path and disrupt the bed of pulp either entering or leaving the annulus between the screens. Not only do these arms interfere with the uniform flow of pulp, but the cracks and crevices produced also provide flow paths for treatment liquids. These flow paths can produce non-uniform concentration or "channeling", of treatment liquids in the pulp bed. The combined effect of the disruption of the pulp bed and channeling of the treatment medium produce inefficiencies that are manifest as non-uniform treatment of pulp and increased chemical consumption.

The rotating liquid distribution arms and nozzles also disrupt the pulp bed and promote non-uniform treatment. Elimination of these elements can not only improve treatment efficiency but also eliminate the drive mechanism and assorted hardware associated with these distribution arms.

The present invention avoids all of these shortcomings of the concentric ring design and provides a much more efficient treatment of the pulp.

A new approach, primarily for an atmospheric diffuser for washing or bleaching cellulose pulp is proposed, although some aspects of the invention may also be applicable to pressure diffusers (at a pressure of more than about 2 atmospheres). The objective is to get high efficiency with no moving parts (in-line), a modular design for improved expandability, and with ready accessibility for maintenance.

As described in U.S. Pat. No. 5,183,536 conventional atmospheric diffusion washer design includes an inherent inefficiency, namely, the dirty "backflush" liquid is undesirably re-introduced to the pulp bed. The actual data from tests performed on conventional atmospheric diffusion washers to determine the extent of this inefficiency appear in Table 1 below. Table 1 contains the average Norden efficiency numbers, often expressed as "$E_k$" numbers, for several atmospheric diffuser operating conditions. The Norden efficiency number provides a relative indication of the washing efficiency of a pulp washing device or stage of a device. The higher the $E_k$ number the higher the washing efficiency of the device or stage. The efficiencies in Table 1 are based upon the removal of both the dissolved sodium and dissolved wood solids from the pulp.

TABLE 1

| AVERAGE NORDEN NUMBER (Sodium and Dissolved Solids) | OVERALL | 1st STAGE | 2nd STAGE |
|---|---|---|---|
| With Backflush on Both Stages | 7.7 ± 0..5 | 4.7 ± 0.3 | 3.0 ± 0.4 |
| Without 1st Stage Backflush | 8.5 ± 1.5 | 5.5 ± 0.9 | 3.1 ± 0.7 |
| Without 1st and 2nd Stage Backflush | 9.5 ± 1.4 | 6.4 ± 1.4 | 3.1 ± 0.2 |

In a conventional two-stage atmospheric diffusion washer, the stages comprise concentric annular screen assemblies mounted for reciprocation within a circular vessel. The pulp flow through these stages is vertically upward and the first stage is mounted beneath the second stage as shown in FIG. 1 of U.S. Pat. No. 5,203,045. During operation, wash water is introduced to the screen assemblies by rotating wash distribution nozzles and then extracted by the annular screens, for example, as clearly shown in FIG. 2 of U.S. Pat. No. 5,203,045. At the same time, the screen assembly is raised by hydraulic cylinders at the approximate speed of the upflowing pulp and then rapidly lowered, or "downstroked". Prior to downstroke, some of the flow of extracted liquid is momentarily reversed, or "backflushed", to dislodge the pulp bed from the screen prior to the downstroking. This very desirable, if not essential, displacement of the pulp bed from the screen assembly prior to downstroking releases the pulp bed from the screen such that the downstroking of the diffuser is neither hindered by the pulp bed, nor is the pulp bed disrupted by the stroking action of the diffuser. However, it is this backflushing of previously extracted liquid that is associated with reducing the washing efficiency of these devices. The data in Table 1 correspond to the overall efficiency and the individual efficiency of each stage of two-stage atmospheric diffusion washer.

The first line of data in Table 1 is associated with normal operation of the two-stage diffuser, that is, with backflushing during both the first and second stages, which is the baseline efficiency for this study. Though the overall efficiency for such a device corresponds to an average $E_k$ of 7.7, most of this efficiency is attributed to the first stage, $E_k$ of 4.7, and less to the second stage, $E_k$ of 3.0. The second line of data corresponds to operation of the two-stage device without backflushing in the first stage. As shown, the overall efficiency increases to 8.5; however, this increase largely occurs in the first stage which compared to the baseline data increased by 0.9 $E_k$ units. The second stage only increased only 0.1 $E_k$ units compared to the baseline.

The third line of data in Table 1 corresponds to operation of the two-stage device without backflush in either of the two stages. Again, the overall efficiency increased under these conditions, however, again, the majority of the increase was seen in the first stage and little or no increase in efficiency was measured for the second stage under these conditions. These results are generally interpreted to mean that backflushing in the first stage has a much more detrimental effect upon the efficiency of a two-stage diffuser. In particular, as described U.S. Pat. No. 5,183,536, this inefficiency is attributed to the location of point of introduction of the backflush liquid relative to the clean pulp. In the lower stage diffuser assembly, the dirty backflush liquor is introduced to a cleaner flow of pulp. This is not the case in the upper stage of a two stage diffuser assembly, as indicated by the data in Table 1. As such, it is undesirable to backflush dirtier liquid into a pulp stream and elimination or minimization of such backflushing is desirable. The present invention provides a diffuser-type washing device which preferably does not require such backflushing.

A second source of inefficiency associated with conventional atmospheric diffusers is the disruption of the pulp bed by the support arms and the consequent source of channeling that this disruption promotes. As the pulp bed rises through the annular screen assemblies it is surmised that the radial support arms provide obstructions to the uniform flow of the annular pulp bed. This disruption and the cracks that are produced undesirably introduce flow paths for the treatment liquid, or channeling of the treatment liquid, that interfere with treatment efficiency. This bed disruption has also been recognized as another source of the inefficiency in the second, upper stage of a conventional two-stage diffuser compared to the first, lower stage. The lower stage treatment zones are not disrupted by the typical radial support structure prior to or during treatment, while the upper stage is located directly above such radial support structures.

In addition, the method of distributing the treatment liquid by rotating nozzles, as shown in FIG. 2 of U.S. Pat. No. 5,203,045, and which characterizes the prior art atmospheric diffusion washers, also introduces undesirable disruptions of the pulp bed which introduces flow paths that promote treatment liquid channeling. It is desirable to minimize or eliminate any source of disruption of the pulp bed, for example, by using a support structure or liquid distribution nozzle that does not traverse the flow path prior to or during treatment. The present invention is also characterized by the minimization or elimination of such structures to provide an undisturbed bed of material for treatment.

The present invention also addresses the washing inefficiencies that are due to the variation in pulp bed permeability that are characteristic of prior art diffusion washing devices. A bed of comminuted cellulosic fibrous material, for example, wood pulp, is compressible under the force of a flow of liquid through the bed. As liquid flows through a bed of pulp, the viscous drag force of the liquid on the pulp compresses the pulp bed in the direction of flow. As the bed is compressed and the interstitial spaces between the pulp particles are reduced in size, a greater restriction to flow is produced. This compression and restriction of flow increase with the flow velocity of the liquid passing through the pulp bed. Ultimately as the flow increases, the compression restricts flow so that little or no flow can pass through the pulp, that is, the permeability of the pulp bed decreases, approaching zero permeability, or no flow. This flow restriction is also a function of the consistency of the pulp and the viscosity of the fluid, among other things. For example, the higher the consistency, the greater the flow restriction.

This permeability phenomenon has a recognized impact upon the operation of diffuison-type washers. Typical values of permeability for the flow from a wash distribution nozzle to a screen are shown in FIG. 15. FIG. 15 illustrates the permeability of the pulp bed between the nozzle and the screen of a conventional diffusion washer for various liquid flow velocities, v. Correspondingly, as the liquid velocity through the bed increases, the permeability decreases and the pressure drop across the pulp bed increases. The typical relationship between liquid velocity and pressure drop across the pulp bed is shown in FIG. 16.

In addition to varying across a pulp bed, the permeability of a bed of pulp can vary along the length of the screen which extracts liquid from the bed. For example, when a bed of pulp encounters an extraction screen, the initial removal of liquid by the screen creates a compression of the pulp bed nearest the screen. Again, this compression of the pulp bed locally decreases the permeability of the pulp near the screen. As the bed of pulp continues to move along the screen, the compression of the pulp bed continues to increase with a consequent loss in permeability. Thus, along the height of an extraction screen in a diffusion-type washer, the permeability may vary dramatically. Tests in a pilot scale diffusion washing device have shown that the permeability may decrease along the height of an annular screen plate so that liquid passes through only part the lower section of screen. That is, in the upper section to the screen, the effect of compressibility and loss of permeability of the pulp bed can prevent the passage of liquid through the bed and to the screen. The efficiency of the conventional device may also suffer from this variation in permeability along the length of the screen. However, in one of the preferred embodiments of this invention, this variation in permeability is recognized and accounted for such that diffuser-type washing efficiency can be markedly enhanced.

Another aspect of any type of treatment of a bed of pulp with a device using a screen-type barrier for isolating liquid from the pulp, for example, for washing, de-watering, or bleaching, is that some accommodation must be made to prevent plugging of the screen surface. In conventional diffusion washers, this pluggage is minimized through backflushing and downstroking. Other prior art, for example, as disclosed in U.S. Pat. No. 4,076,623, suggest vibrating or oscillating the screening surface to dislodge the pulp and minimize screen pluggage. In ether case, some form of relative movement between the screen surface and the pulp bed is used to minimize screen pluggage and maintain operation of the device.

However, it is undesirable that such movement disrupt or somehow disturb the bed of pulp during treatment. Diffusion washing is preferably performed with a uniform flow, or diffusion of treatment liquid, through a uniform pulp bed with little or no disruption of the pulp bed. Disruption or disturbing the pulp bed can lead to non-uniform flow of liquid through the bed or non-uniform flow of pulp through the treatment zone which can lead to non-uniform or less than desirable treatment of the pulp. This non-uniform flow of either liquid or pulp is typically referred to as "channeling" of the liquid or pulp and is undesirable. It is preferred that any relative movement of the screen or other device not interrupt or disturb the pulp bed.

The potential for disturbing the pulp bed is highly contingent upon the strength of the pulp bed, that is, how much load or pressure the pulp bed can withstand without "breaking" or shearing or otherwise promoting inefficient pulp or liquid channeling or mixing. A typical relationship between pulp bed strength and consistency (also known as "Solids Fraction") is shown in FIG. 17. As the consistency of a bed of pulp increases, the load which the bed can withstand without being disrupted increases. The present invention seeks to limit the disruption of the pulp bed exceeding the strength of the bed.

The present invention utilizes the solids flow design principles and pulp bed compaction and permeability principles used in the development and design of Diamondback® chip bins, or like vessels, developed and marketed by Ahlstrom Machinery Inc. of Glens Falls, N.Y. (such as shown in U.S. Pat. Nos. 5,500,083 and 5,617,975). In addition these principles are also employed to provide smooth flow transitions from the treatment zone of the treatment vessel to the discharge of the vessel.

While in the description of the present invention provided, the invention is described with respect to washing of a liquid slurry of solid material, particularly medium consistency pulp, it should be understood that the invention also is applicable to simply thickening the pulp (that is removing liquid from it but not adding additional displacement liquid), and for other treatments aside from washing, such as using a bleaching liquid to bleach the pulp, etc. Though this invention can be practiced in a pressurized vessel, the invention is most suitable for substantially atmospheric pressure treatment. Normally the treatment will be at a pressure slightly above atmospheric, but in a preferred embodiment no attempt is made to specifically pressurize the vessel in which treatment takes place, and the pressure is always significantly less than two atmospheres.

According to one aspect of the present invention a diffusion assembly is provided for treating a liquid slurry of solid material (e.g. cellulose pulp at a consistency of about 8–15%). The assembly comprises the following components: A substantially upright vessel (e.g. at substantially atmospheric pressure) have a non-circular cross-section, defined by a vessel wall, for at least a treatment portion thereof, the treatment portion between an inlet: and an outlet for liquid slurry. At least one screen surface for removing some of the liquid of the liquid slurry from the treatment portion of the vessel, but minimal solids slurried by the liquid. And, the vessel and the at least one screen surface, constructed and positioned with respect to each other so that during treatment the liquid slurry has a substantially uniform width in the treatment portion and there is substantially uniform resistance to the flow of slurry over the screen surface over any particular cross-section of the vessel in the treatment portion.

While the vessel may have a substantially square, rectangular, oval, or like configuration, in the preferred embodiment the vessel has a substantially race track shape in cross-section at the treatment portion. The race track shape minimizes the size, or area, of the device. For some aspects of the invention the configuration may be circular.

In one embodiment the screen surface is mounted interiorly of the vessel treatment portion, and the assembly further comprises treatment liquid introducing means (such as slots, headers, apertures, baffles, nozzles, orifices, and/or other conventional liquid introducing structures) operatively mounted in or with the vessel wall for introducing treatment liquid into the slurry in the vessel treatment portion.

Typically the screen surface is substantially vertical and comprises screening portions vertically spaced by non-screening portions. In order to provide optimum permeability for the pulp as it moves through the vessel, the vessel wall bulges out substantially at the location of the non-screening portion so as to provide a slurry width thereat at least five percent wider (e.g. 5–30% wider, and all smaller ranges within that broad range) than at the screening portions associated therewith, so as to allow the pulp to "relax" to regain at least some of the permeability that it had before passing into contact with the screening portions. This recovery of permeability permits the further treatment of the pulp.

The screen surface may be mounted interiorly of the vessel by a plurality of hollow supports which both support the screen surface and remove liquid which passes through the support surface from the vessel, and the assembly may further comprise means for moving the screen surface at spaced points in time so as to substantially prevent plugging of the screen surface. The moving means may be conventional reciprocating devices (such as pneumatic cylinders), vibrators which vibrate the screen surface up and down and/or horizontal, or any other conventional such structure. Alternatively the means may be for rotating the screen surface about a substantially vertical axis, or for vibrating or oscillating the screen surface in a substantially horizontal dimension.

Typically the vessel inlet is at the bottom thereof and the vessel outlet is at the top. A one dimensional convergence and side relief structure may be directly connected to, or form at least part of the outlet.

The vessel, liquid introducing means, and at least one screen surface may be constructed and positioned with respect to each other so that the maximum and minimum permeability of a bed of the liquid slurry during passage through substantially the entire treatment portion of the vessel is a maximum of about 1000 lbs. per square foot per foot, preferably a maximum of 750 lbs./ft.$^2$/ft., most preferably a maximum of 500 lb./ft.$^2$/ft. That is the consistency is never more than 18%, preferably less than 16%, most preferably less than 14%, and typically is between about 8–14%. The slurry width may form an annulus in the vessel, and the annulus is preferably substantially uninterrupted in the treatment zone, there being no significant physical impediment such as arms in conventional diffusers. The assembly is typically provided in combination with a plurality of like vessels, and an exterior vessel, the exterior vessel mounting the plurality of like vessels within it. While the vessels are like each in the configuration, they may differ in dimension within the exterior vessel.

The invention also relates to a method of treating a slurry of compressible comminuted cellulosic fibrous material (e.g. pulp having a consistency of between about 8–15%), having a permeability that varies as it is compressed, in a treatment zone. The method comprises: (a) Introducing a flow of the slurry into the treatment zone (e.g. which may be at substantially atmospheric pressure) to form a bed of slurry having a first side and a second side, and a width. (b) Passing the slurry through the treatment zone. (c) In the treatment zone introducing a treatment liquid into the bed at the first side thereof so that the liquid passes from the first side through to the second side thereof. (d) Removing at least some of the liquid from the second side of the bed. And, wherein (a)–(d) are practiced so that the permeability of the slurry bed in the treatment zone is a maximum of 750 lbs./ft.$^2$/ft. (e.g. a maximum of 500 lbs./ft.$^2$/ft.).

In the method (b) is preferably practiced substantially without disrupting the flow of slurry (that is with no arms or like physical impediments as in conventional diffusers). In the method (c) and (d) are preferably not practiced at spaced locations as the slurry moves through the treatment zone, and the method further comprises increasing the width of the slurry bed at the spaced locations where (c) and (d) are not practiced, to allow the slurry to recover substantially its permeability before practice of (c), e.g. by increasing the width at least about five percent. In the method (a) and (c) are typically practiced in substantially vertical paths, whereas (c) is practiced in a substantially horizontal path.

In the method (a)–(d) may be practiced to establish a plurality of substantially parallel beds of slurry in treatment zones, and to treat the slurry in all of the plurality of beds and treatment zones at substantially the same time. The method also comprises combining the plurality of beds after treatment thereof, such as for further treatment (e.g. in a bleach plant or the like). In the method (c) is typically practiced using the wash liquid to effect washing of the material of the slurry, but other treatment processes may also be carried out, such as bleaching or delignification.

According to another aspect of the present invention there is provided a method of treating a slurry of compressible comminuted cellulosic fibrous material as described above in a treatment zone comprising: (a) Introducing a flow of the slurry having a consistency of between about 8–15% into the treatment zone to form a bed of slurry having a first side and a second side, and a width. (b) Passing the slurry through the substantially atmospheric pressure treatment zone. (c) In the treatment zone introducing a treatment liquid into the bed at the first side thereof so that the liquid passes from the first side through to the second side thereof. (d) Removing at least some of the liquid from the second side of the bed. And, wherein (a)–(d) are practiced so that the slurry has a consistency at all times throughout the treatment zone of between about 8–18% (preferably 8–16%, most preferably 8–14%; and a difference of less than 6%); and wherein (b) is practiced substantially without disrupting the flow of slurry.

The details of the individual elements of the method practiced may be as described with respect to the previous aspect of the invention. In either aspect, (d) may be practiced by passing the slurry into contact with a screen surface, liquid passing through the screen surface. The method may further comprise at spaced points in time moving the screen surface to substantially reduce surface friction, but preferably by rotating the screen surface about a substantially vertical axis, or vibrating or oscillating the screen in a horizontal direction (substantially transverse to the direction of movement of pulp through the vessel)).

The present invention may consist of or comprise a method of treating a compressible comminuted cellulosic fibrous material, having a permeability that varies as the material is compressed, in a treatment zone, including: (a) introducing a flow of comminuted cellulosic fibrous material to a treatment zone to form a bed of material having a first side and a second side and a width; (b) passing the material through the treatment zone; (c) introducing a treatment liquid to the first side of the bed; and passing the treatment fluid from the first side of the bed to the second side; and (d) removing at least some of the liquid from the second side of the bed.

The method is preferably practiced so as to substantially prevent the loss of permeability of the bed to the treatment fluid. In a preferred embodiment, (b) is practiced substantially without disrupting the bed of material in the treatment zone. In another embodiment, (c) and (d) are practiced by intermittently stopping the removal of treatment liquid from the material. In another embodiment, while performing (c)–(d), the method also comprises allowing the material to recover at least some of the permeability lost during the practice of (c)–(d). One preferred way of recovering at least some of the lost permeability is by increasing the width of the bed.

According to another aspect of the invention there is provided a method of treating a slurry of compressible comminuted cellulosic fibrous material, having a permeability that varies as it is compressed, in a substantially annular [e.g. substantially atmospheric pressure] treatment zone, comprising: (a) introducing a flow of the slurry having a consistency of between about 8–15% into the treatment zone to form a bed of slurry having a first side and a second side, and a width; (b) passing the slurry through the [e. g. substantially atmospheric pressure] treatment zone; (c) in the treatment zone introducing a treatment liquid into the bed at the first side thereof so that the liquid passes from the first side through to the second side thereof; (d) removing at least some of the liquid from the second side of the bed; and practicing (a)–(d) so as to positively control in the treatment zone the pressure drop across the bed, the friction load, the consistency of the slurry, the inverse of permeability, and the inverse of bed strength, so as to limit the negative impact thereof upon treatment efficiency.

The invention also relates to a diffusion assembly for treating a liquid slurry of solid material, the assembly comprising: A substantially upright vessel defined by a vessel wall, for at least a treatment portion thereof, the treatment portion between an inlet and an outlet for liquid slurry. At least one screen surface for removing some of the liquid of the liquid slurry from the treatment portion of the vessel, but minimal solids slurried by the liquid, the screen surface substantially vertically elongated. And, means for occasionally moving the screen surface in a direction or manner distinct from the vertical so as to minimize plugging thereof.

The moving means may comprise means for rotating the screen surface about a substantially vertical axis less than 30 degrees (e.g. 5–30°) or means for vibrating or oscillating the screen surface in a substantially horizontal direction.

The invention also relates to a diffusion assembly for treating a liquid slurry of solid material, the assembly comprising: A substantially upright vessel defined by a vessel wall, for at least a treatment portion thereof, said treatment portion between an inlet and an outlet for liquid slurry. At least one screen surface for removing some of the liquid of the liquid slurry from the treatment portion of the vessel, but minimal solids slurried by the liquid, the screen surface substantially vertically elongated and comprising screening portions vertically spaced by non-screening portions. Treatment liquid introducing means for introducing treatment liquid into the slurry in the vessel treatment portion. A volume through which the slurry flows between the screen surface and the treatment liquid introducing means in the treatment portion, the volume having a width. And, the vessel, screen surface, and liquid introducing means positioned with respect to each other so that the width in the treatment portion increases by at least about 5% at at least one of the non-screening portions.

The treatment liquid introducing means may be mounted in or operatively associated with the vessel wall, and the screen surface is mounted interiorly of the vessel, the vessel wall may bulge out substantially at the location of the non-screening portions so as to provide the wider slurry width thereat. The means described above for occasionally moving the screen surface in a direction or manner distinct from the vertical may also be used.

It is the primary object of the present invention to provide a method and apparatus which substantially overcomes the washing inefficiencies due to the variation in pulp bed permeability that are characteristic of conventional diffusion washers particularly atmospheric diffusion washers. The stationary operation of the present invention also provides for a less expensive and easier to maintain device. The modular design also allows for easier and less costly capacity increases. This and other objects will become clear from an inspection of the detailed description of the invention and from the appended claims.

BRIEF DESCRIPTION OF THE DRAWINGS

FIG. 1 is a side schematic elevational view of an exemplary diffusion washer according to one embodiment of the present invention;

FIG. 2 is an end elevational schematic view of the washer of FIG. 1;

FIG. 3 is a top plan schematic view of the washer of FIGS. 1 and 2;

DETAILED DESCRIPTION OF THE DRAWINGS

Figure 4:
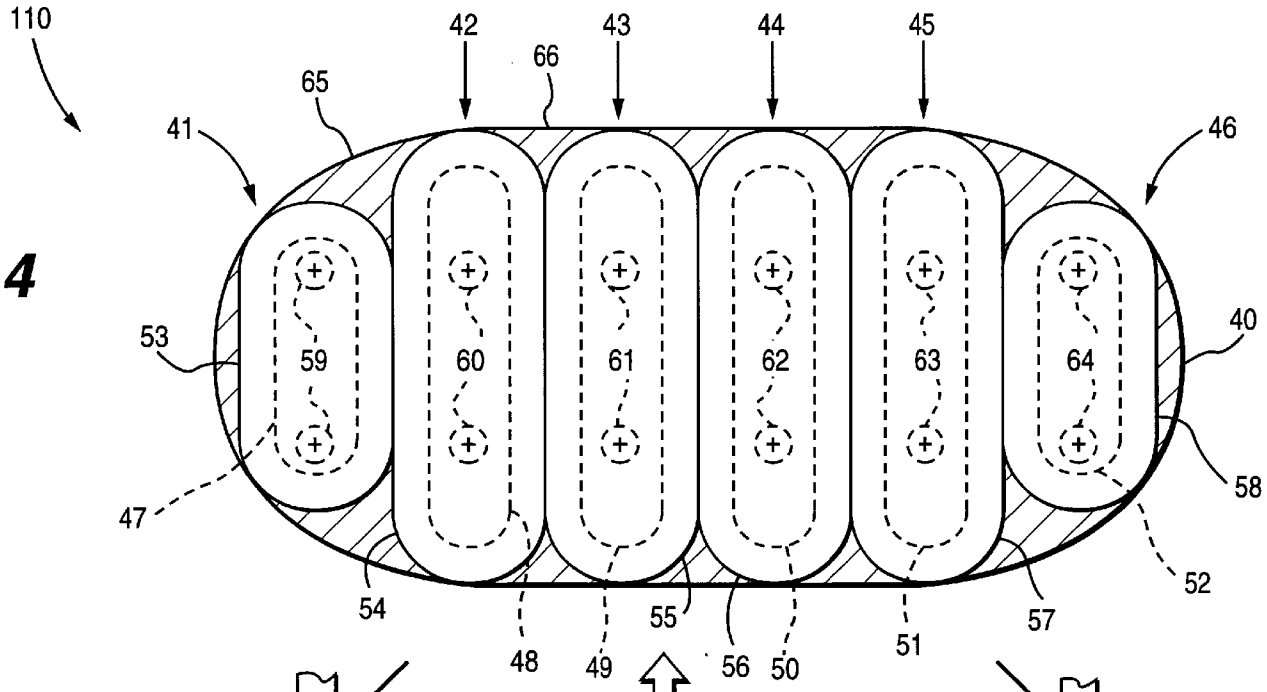
FIG. 4 is a top plan schematic view of a multi-unit washing device according to the present invention.

FIGS. 1, 2 and 3 illustrate one embodiment 10 of the present invention. FIG. 1 is a schematic elevational view in cross section; FIG. 2 is a schematic elevational view in cross section viewed from the right side of FIG. 1; and FIG. 3 is a schematic cross sectional view taken through section 3—3 of FIG. 1.

The embodiment 10 shown in FIG. 1 consists or comprises a vessel shell 11, having an inlet 12 and an outlet 13, and an extraction screen assembly 14 suspended within vessel 11 by at least one support and liquid removal conduit, e.g. the two conduits 15 and 16. The flow of wood pulp slurry, or other slurry of comminuted cellulosic fibrous material, is indicated by arrow 17. Vessel 11 includes a diverging inlet transition 18 and a converging outlet transition 19. These transitions 18 and 19 may be simple tapered transitions or they may be transitions exhibiting single-convergence and side-relief geometry, for example, as disclosed in U.S. Pat. Nos. 4,958,741; 5,500,083; 5,617,975; and 5,628,873.

The extraction screen assembly 14 consists or comprises a device that when the pulp flow 17 is introduced to the vessel 11 a uniform bed of moving pulp 24 having a thickness 23 is produced between the outside surface of the screen assembly 14 and the inside surface of vessel 11 to define a treatment zone 26. In the preferred embodiment shown, the screen assembly consists or comprises an inlet deflection wedge 20, an outlet transition wedge or pyramid 21, and an extraction screen section 22. The extraction screen 22 extends throughout the treatment zone 26 (best seen in FIG. 1) and may be of any form of apertured or perforated screen or membrane that permits the passage of liquid while preventing the passage of comminuted cellulosic fibrous material. The screen 22 may be made from perforated plate or from a parallel-bar-type construction. The perforations may be circular holes or elongated slots (see FIG. 18 for example). The perforations or orifices defined by the slots or bars may be oriented in any desirable orientation, for example, they may be oriented horizontal, vertical, or slanted at any oblique angle, for example, at an angle between about 30 to 60 degrees from the horizontal or vertical.

The extraction screen 22 may comprise or consist of discontinuous perforated sections 25 (see FIG. 18) having unperforated sections 25*a* (FIG. 18) therebetween as the pulp flows from the inlet 12 to the outlet 13. These perforated and unperforated sections 25, 25*a,* respectively, may vary in length. In one preferred embodiment of this invention, the length of the perforated and unperforated sections 25, 25*a* of screen assembly 22 are varied to minimize and control the permeability of the bed of material. For example, based upon the flow and permeability characteristics of the material being treated, the length of the perforated sections 25 of screen 22 may be varied to prevent the loss of permeability in the material bed. As discussed earlier, the permeability of the treatment bed typically may vary along the length of the treatment zone. In a preferred embodiment of this invention, this loss of permeability is recognized and accounted for by limiting the length of individual extraction screen perforated section 25 in the treatment zone. In addition, the extraction screens are preferably followed by unperforated (or plugged) zones 25*a,* i.e. zones where liquid is not passing through the material bed, which allows the material bed to "relax" and recover at least some of the permeability lost during treatment.

Instead of the portions 25*a* being solid metal (e.g. titanium) they may be plugged screen sections. That is screen apertures therein may have removable plugs therein. In this way the relative amount of screen section versus solid section may be adjusted.

Figure 19:
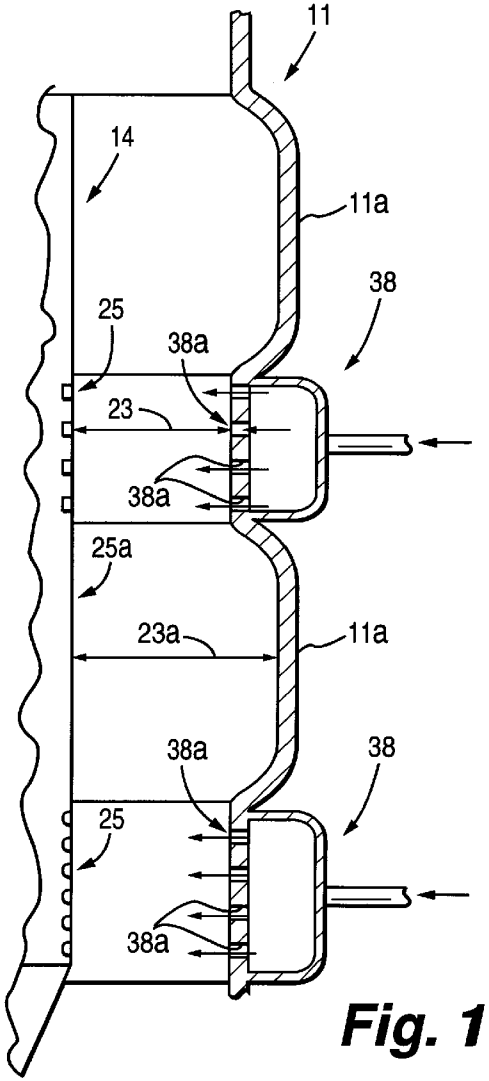
FIG. 19 is a view of the embodiment of FIG. 18 showing the vessel wall as it bulges outwardly where non-screening portions of the screen assembly of FIG. 18 are provided, FIG. 19 being vertically aligned as in FIG. 18.
Figure 18:
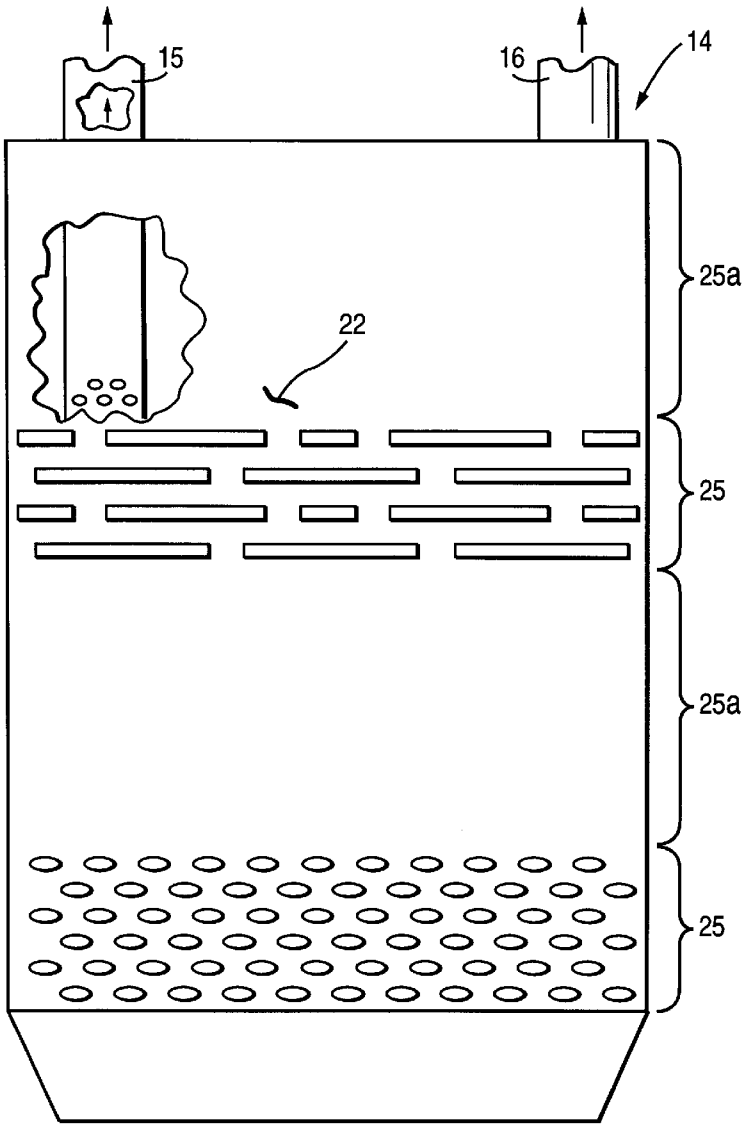
FIG. 18 is a detail schematic front view, with portions cut away to illustrate interior, of an exemplary screen surface and supporting members of the embodiment of FIGS. 1 through 3.

Note that FIG. 19 is aligned with FIG. 18 to show where the bulges 11*a* may be provided relative to the screen 22 screening and solid sections 25, 25*a* respectively (in the embodiment illustrated, the bulges 11*a* aligned with the solid, non-screening, portions 25*a*).

The width 23 of the pulp bed 24 (see FIGS. 2 and 3) in these relaxation zones may be the same as the width of the bed in the treatment zone having a perforated screen section 25, but, according to a preferred embodiment of this invention, the width of the bed of material following a zone in which the material is treated is followed by a zone having a larger, that is, wider, bed width, as indicated by the outward bulge sections 11*a* (see FIG. 19) of the vessel 11. This wider bed width 23*a* (at 11*a* in FIG. 19) promotes the relaxation of the pulp bed and the recovery of the permeability of the material for subsequent treatment. These zones having wider bed widths 23*a* may be created by an abrupt increase in the width between the surface of the extraction screen 22 and the internal surface in the vessel wall 11, that is, what is called a "step-out", or a gradual increase to a maximum width, as indicated at 11*a* in FIG. 19. After the increase to the maximum width of the bed, the bed width is preferably decreased, again, either abruptly or gradual, to the width of the original bed. Of course, depending upon the compressibility of the material, the subsequent bed width may be greater or lesser than the earlier or previous bed width. The amount of increase is preferably such that the width of the bed 24 increases by at least 5%, e.g. 10–30%.

The cross section of the vessel 11 and screen assembly 14, see FIG. 3, may take any desirable form, for example, the cross section of each member may be substantially square, rectangular, ovoid, or circular. However, the preferable cross section is the substantially rounded rectangular cross section (i.e. race-rack shape) shown in FIG. 3. This substantially rounded rectangular cross section provides for the most uniform material bed width, 23, so that the most uniform treatment of the material is obtained, while minimizing the size of the device.

Also, according to this invention, the internal surface of vessel 11 in the treatment zone 26 includes some means, shown schematically only at 38 in FIGS. 1–3 for distributing treatment liquid 27 to the bed of material 24 in the treatment zone. This means of distribution preferably consists or comprises any conventional device for distributing, preferably as uniformly as possible, treatment liquid (e.g. wash liquid or bleach liquid) to the material 24 in the treatment zone 26. As discussed above with respect to the extraction screen 22, this distribution means may comprise perforated plate or parallel-bar-type structures. However, one preferred means for distributing liquid to the bed comprises or consists of series of spaced annular slots 38*a*(see FIG. 19) positioned along the internal surface of vessel 11 in the treatment zone 26. The spacing of these slots 38*a* may be uniform or may vary, for example, the spacing between successive slots 38*a* may uniformly, or not so uniformly, decrease from the bottom of the treatment zone 26 near the inlet 12 to the top of the treatment zone 26 near the outlet 13 of the vessel 11.

According to the present invention the screen assembly 14 is supported by a support that does not interfere with the integrity of the pulp bed 24 prior to or in the treatment zone 26. In the preferred embodiment shown in FIG. 1 the screen 22 is supported from above by two supports 15, 16, that also act as extraction conduits for removing liquid extracted through the screen assembly 14. Supports 15, 16 are attached to a structural support 32, for example, an annular ring. Though two hollow supports 15, 16 are shown in FIG. 1 it is understood that one or more supports, for example, three or four support beams or columns may also be used. In addition, though it is preferred to have the same structure (i.e. hollow supports 15, 16) provide both the function of support and the function of liquid removal, these functions may also be provided by separate structures, for example, the screen assembly 14 may be supported by one or more vertical beams 15, 16, while liquid is removed by one or more separate conduits.

The liquid removed by screen assembly 14 may be passed to the hollow columns/conduits 15, 16 by whatever conventional means are desired. For example, the liquid may pass through holes or perforations along the length of the hollow columns/conduits 15, 16, or the liquid in assembly 14 may be directed to one or more holes in the hollow columns/conduits 15,16, for example, by one or more internal baffles (not shown) in screen assembly 14. In a preferred embodiment, the liquid removed through screens 22 and located inside screen assembly 14 is passed through one or more specially-designed orifices 28 in the plate 29 (see FIGS. 2 and 3) which defines the lower wall of cavity or header 30. The liquid in cavity or header 30 is then passed through one or more holes 31 in conduits 15, 16 and passed to an external location via conduits (not shown) which communicate with conduits 15,16.

In one preferred embodiment, the screen assembly 14 is moved to create some form of relative movement between the surface of screen 22 and the pulp bed 24. This movement aids in preventing the buildup of material on the screen surface and the pluggage of the perforations in the screen. One form of movement that can be used is the slow upstroke, rapid downstroke regime that is common to conventional diffusion washers, as shown by double arrow 34. In this mode, the structural support is attached to one or more sources of movement such as one or more hydraulic or pneumatic cylinders, one shown only schematically at 39 in FIG. 1. In a preferred embodiment, the motion of the screen assembly 14 is provided by one or more sources of vibration or oscillation 33 attached to the supports 15, 16, and 32 via connection 35. This vibration or oscillation may impart vertical translation of the assembly 14 as shown by double arrow 34 or lateral or horizontal movement may also be imparted. Other movement means are described with respect to FIGS. 21 and 22.

In order to guide and support the motion of the screen 14 and supports 15, 16, one or more sliding bearings or packings 36 and appropriate bearing housings 37 may be provided on vessel 11.

The embodiment of the present invention 10 shown in FIG. 1 may be used as a single device or may be used in conjunction with one or more additional similar or identical devices. These devices may be arranged in series, with the outlet of one communicating with one or more of inlets of others, or the devices may be arranged in parallel. A typical parallel multi-unit-type arrangement is shown in FIGS. 4 and 5.

Figure 5:
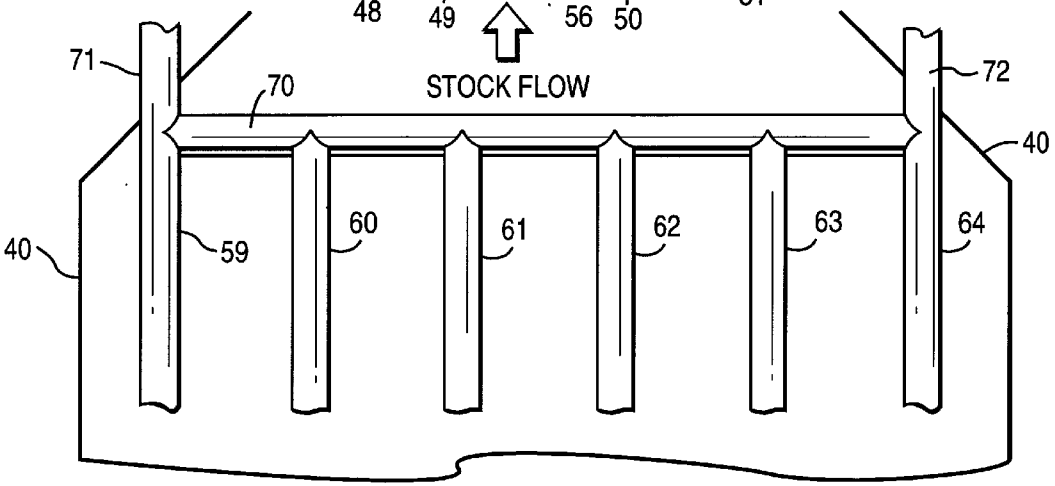
FIG. 5 is a partial side elevational schematic view of the device of FIG. 4.

FIG. 4 illustrates a top view of multi-unit device according to the present invention. The view in FIG. 4 is similar to the top view shown in FIG. 3 for the single-unit device. Though such device may comprise or consist of two or more units 10, FIG. 4 illustrates a device 110 having six units 41–46 located in exterior vessel 40, comprising or consisting of six screen assemblies 47–52similar to screen assembly 14 in FIGS. 1–3, and six external liquid distribution arrangements 53–58, similar to means 38, 38*a* of FIGS. 1–3 and 19. Screen assemblies 47–52 are supported by support and liquid removal conduits 59–64 which are similar to conduits/supports 15,16 of FIG. 1. Conduits/supports 15, 16 communicate with one or more conduits for removing the liquid and, if desired, one or more means of moving the screens 47–52, such as device 33 in FIG. 1.

FIG. 4 also illustrates several shell transitions 65, 66 between the outer surface of distribution devices 53–58 and the internal surface of vessel 40. These transitions direct the flow of material from the inlet of exterior vessel 40 (not shown) to the inlets of each of the devices 41–46 so that the material flows essentially uniformly from one common inlet of vessel 40 to each device 41–46. Similar transitions may also be provided to transition the flow of material 24 from the outlet of each device to the outlet of vessel 40 (not shown).

Though the present invention preferably does not require the use of backflushing to separate the surface of screen 22 from the pulp bed 24, it is understood that some form of conventional backflush system can be used in conjunction with the present invention. If such a backflushing system is used, it is preferred that some form of means be provided io prevent the undesirable mixing relatively dirty backflush liquid with the cleaner pulp. For example, some form of internal baffling can be used in screen assembly 14 to prevent such undesirable mixing, such as shown in U.S. Pat. No. 5,183,536.

FIG. 5 is a partial side schematic elevational view of the multi-unit device shown in FIG. 4. FIG. 5 shows how the extraction conduits/supports 59–64 communicate and are attached to one of at least two common supports/headers 70. FIG. 5 also shows how one or more supports/headers 70 can be attached to two or more conduits/supports 71 and 72 for removing liquid and supporting the structure and, if desired, connecting to a means for moving the screen assemblies 47–52.

Figures 6, 7:
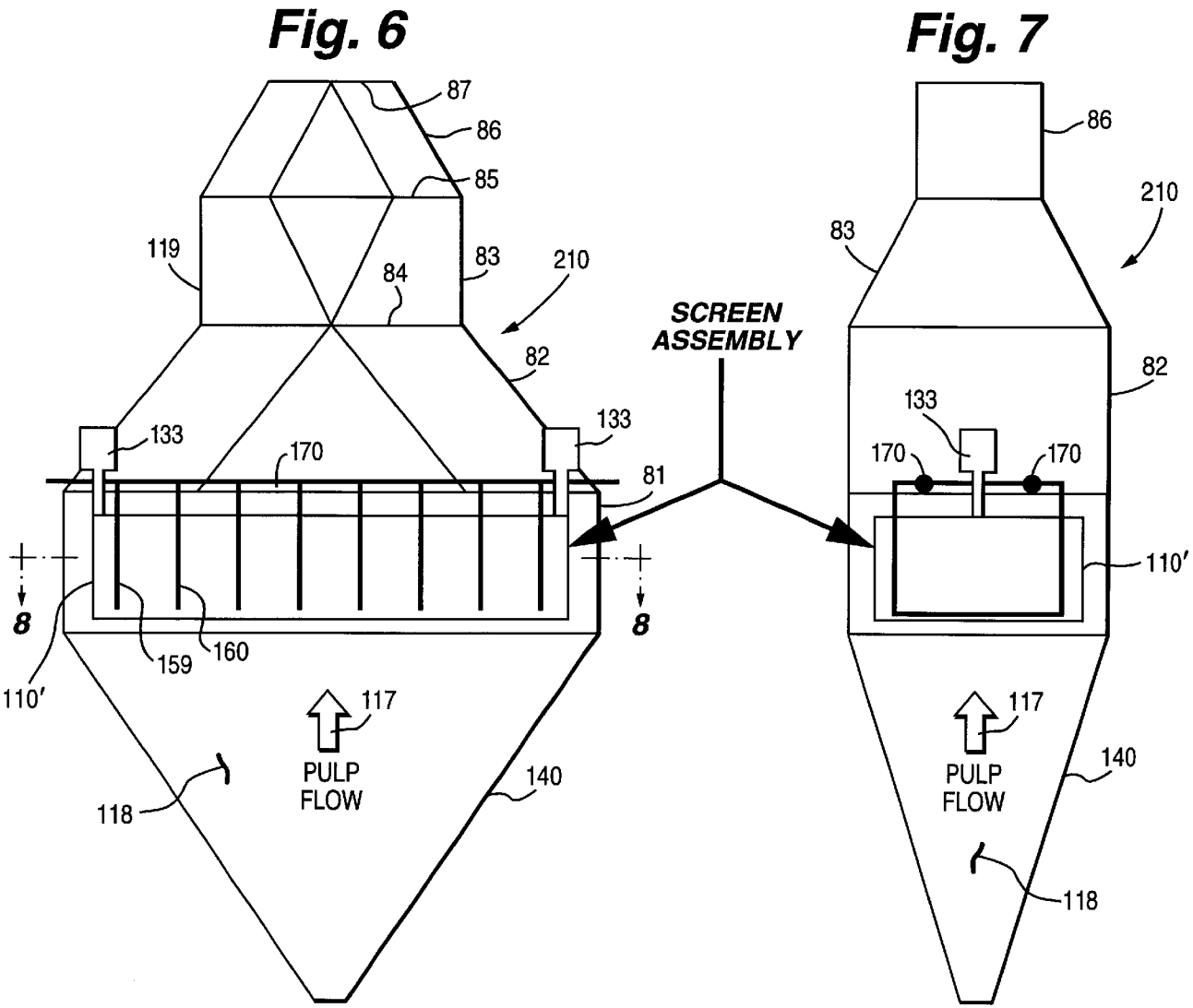
FIGS. 6 and 7 are schematic side and end elevational views of another embodiment of a multi-stage device according to the present invention.

FIGS. 6 and 7 illustrate an additional embodiment 210 of the multi-stage device according to the present invention. In FIGS. 6 and 7, a multi-unit device 110', similar to device 110 in FIGS. 4 and 5, is located in vessel 140 in which pulp is introduced as shown by arrow 117. Vessel 140 includes a tapered, conical inlet section 118 and an outlet section 119. The outlet section 119 is characterized as having a geometry that has single-convergence and side relief, that is a Diamondback® geometry as described in the above referenced patents. The use of such an outlet geometry is not limited to the treatment device of the present invention. but is applicable to any outlet of any type of vessel that handles particulate material, which is prone to non-uniform movement when passed in an upward direction from a vessel having a first larger dimension to second smaller dimension, for example, to a vessel outlet.

Specifically, in the outlet transition shown in FIGS. 6 and 7, the generally race-track oval cross section 81 of vessel 140 is transitioned by transition 82 to a circular cross section at interface 84 via single-convergence and side-relief geometry. From the circular cross section at 84, the transition 83 changes the material flow path to a second, smaller race-track oval geometry at interface 85. Then, transition 86 changes the flow path to a smaller circular flow path at outlet 87.

Figure 8:
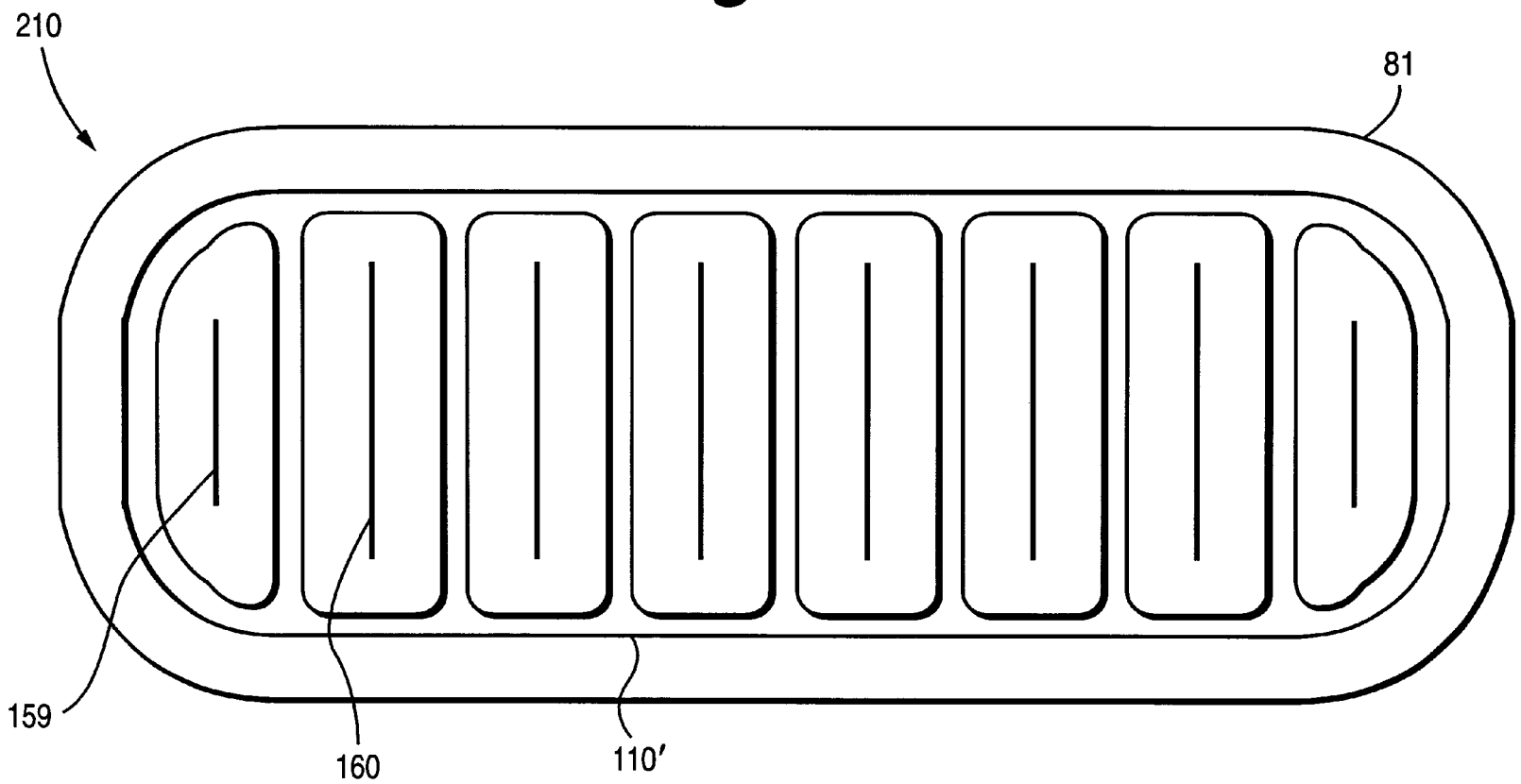
FIG. 8 is a schematic top cross-sectional view of the embodiment shown in FIG. 6 taken along lines 8—8 in FIG. 6.

FIGS. 6 and 7 also illustrate the extraction conduits 159, 160, etc. which are supported and communicate with common extraction header 170, and typical hydraulic or oscillation or vibration devices 133. This configuration is also clear from FIG. 8, which is top cross sectional view of the embodiment shown in FIG. 6 taken through the section 8—8.

Figure 9:
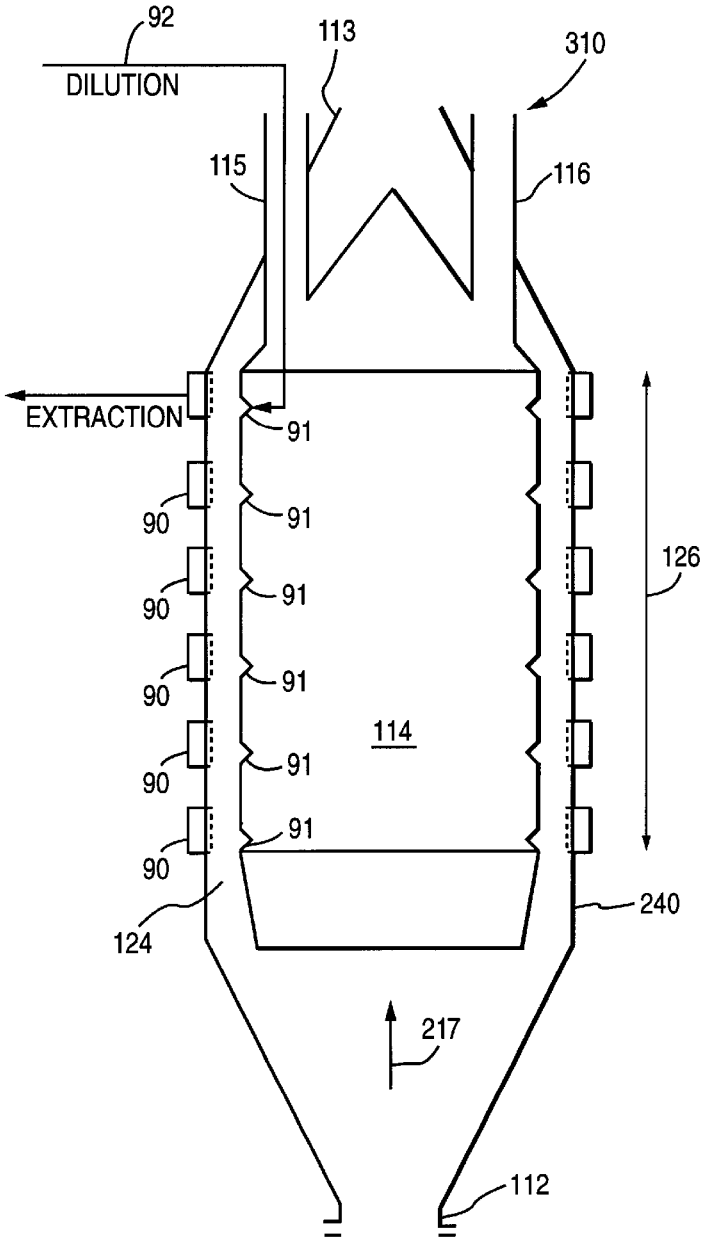
FIGS. 9 and 10 are views similar to FIGS. 1 and 2 only showing another embodiment according to the present invention.
Figure 10:
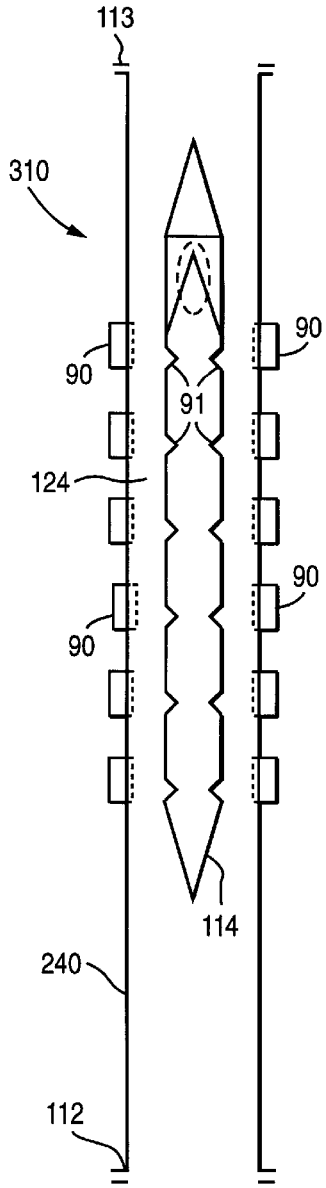

FIGS. 9 and 10 illustrate another embodiment of the present invention 310 which is similar to the embodiment shown in FIGS. 1–3, but in which the flow of liquid through the bed of material is reversed. Where in the FIG. 1 embodiment the flow of treatment liquid was from the outside in, in FIGS. 9 and 10, the flow of liquid is from the inside out. Many of the structures shown in FIGS. 1–3 are similar if not identical to those shown in FIGS. 9 and 10.

Similar to FIGS. 1–3, 18 and 19, device 310 includes a vessel 240, having an inlet 112 and an outlet 113 and a flow of material indicated by arrow 217 to form a bed of material, again, for example, pulp, 124 in treatment zone 126. However, unlike the device shown in FIGS. 1–3, device 310 includes a liquid distribution chamber 114 supported by supports/conduits 115, 116, through which treatment liquid 92 is passed to chamber 114. Similar to the distribution section 38 in FIG. 1, distribution chamber 114 includes means for distributing treatment liquid to the pulp bed 124 in zone 126. Though any conventional distribution means may be used, chamber 114 preferably comprises annular liquid introduction baffles 91 that uniformly introduce a flow of treatment liquid to bed 124. This liquid is withdrawn from the bed 124 by an annular extraction screens 90 located along the internal surface of vessel 240. These screens may consist of a plurality of perforated regions, for example, perforated plates or bar-type screens. These perforated regions may be evenly spaced along the height of the vessel 240 in the treatment zone 126 separated by unperforated regions as shown, or the length and spacing of the perforated and unperforated regions, as described above with respect to the embodiment of FIGS. 1–3, 18 and 19. In this embodiment, the distribution chamber 114 and extraction screens 90 are essentially stationary.

Figure 11:
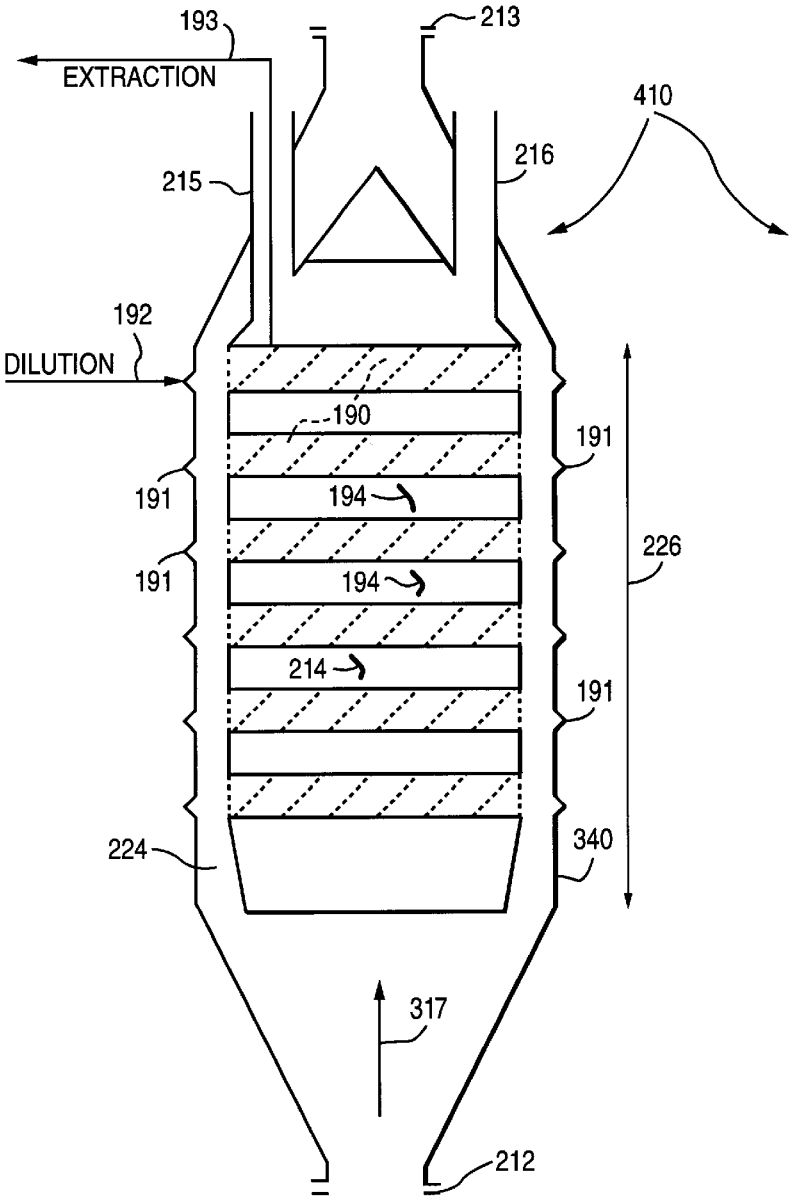
FIGS. 11 and 12 are views like FIGS. 1 and 2 only showing yet another embodiment according to the present invention.
Figure 12:
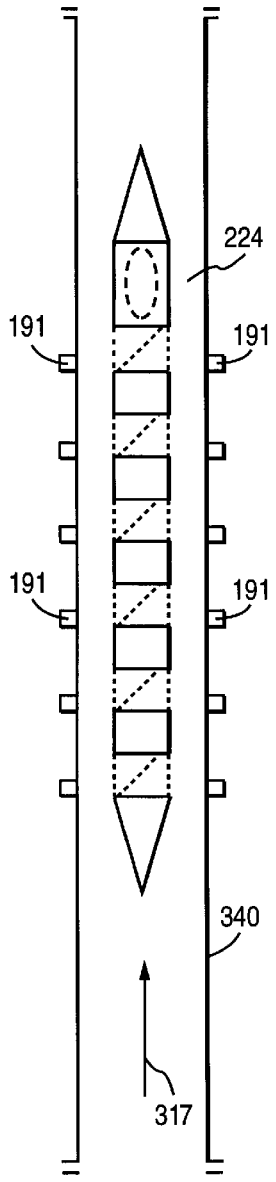

FIGS. 11 and 12 illustrate another embodiment 410 of the present invention. The embodiment shown in FIGS. 11 and 12 is very similar to the embodiment shown in FIGS. 1–3. As in the earlier embodiment, the flow of liquid is from the outside in.

Many of the structures shown in FIGS. 11 and 12 are essentially identical to those shown in FIGS. 1 and 2. FIGS. 11 and 12 illustrate a vessel 340 having an inlet 212 and an outlet 213 and an extraction chamber 214 suspended in the vessel by supports/conduits 215 and 216. The material flows in the direction of arrow 317 and forms a bed of pulp 224 in treatment zone 226 between the outside of chamber 214 and the inside wall of vessel 340. Treatment liquid is introduced to the bed of material 224 by means of liquid distribution means located in the wall of vessel 340 adjacent the treatment zone 226. As shown in FIGS. 11 and 12, one preferred means of distribution treatment liquid to the material is by a series of annular liquid introduction openings 191 that communicate with a common source of treatment liquid.

The extraction chamber 214 preferably comprises or consists of a series of perforated sections 190, such a perforated plates or parallel-bar type structures, separated by unperforated sections 194. As discussed above, as the treatment liquid 192 is introduced to and passes through bed 224 the liquid is extracted from the bed via perforated sections 190 such that the mat of material is compressed against the perforated section 190 and some of the permeability of the material is lost. As also noted above, after the bed of material passes each of the perforated sections 190 the material flows passed an unperforated section 194 through which no liquid is extracted. The interruption of the liquid removal from the bed allows the bed material to "relax" and recover at least some of the permeability lost during the removal of liquid from perforated section 190. The material mat then proceeds to the next perforated section 190 and the mat is again compressed as liquid is extracted.

Again, though the spacing and width of sections 190 and 194 are shown somewhat uniform in FIGS. 11 and 12, the spacing and width of these sections may vary. This will be discussed more completely with respect to FIG. 21.

Figure 14:
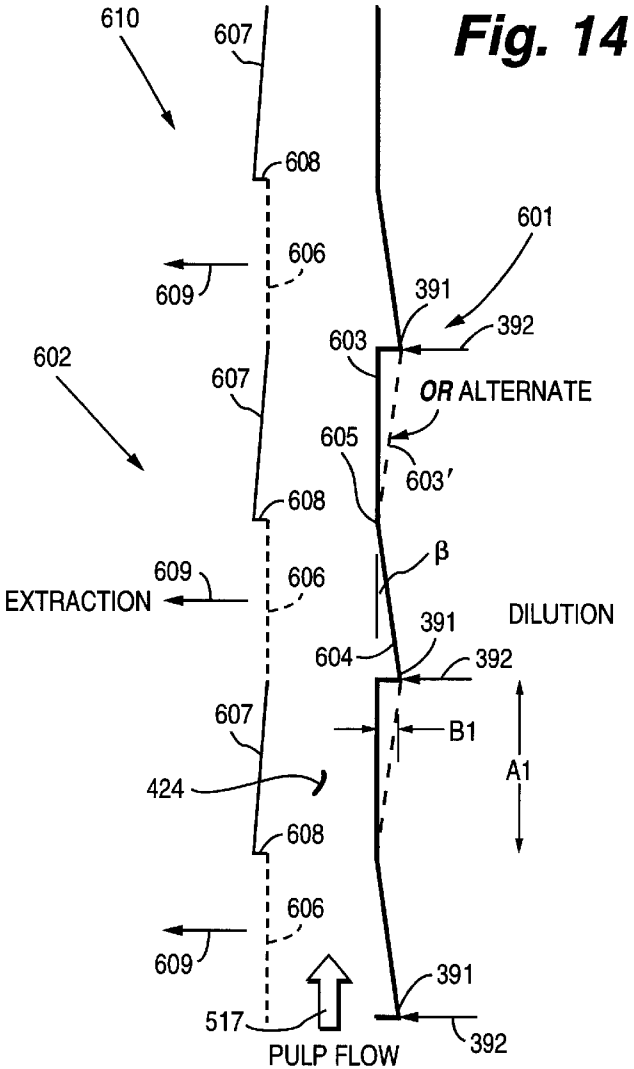
FIG. 14 is a view like that of FIG. 13 only for another embodiment of the invention.
Figure 13:
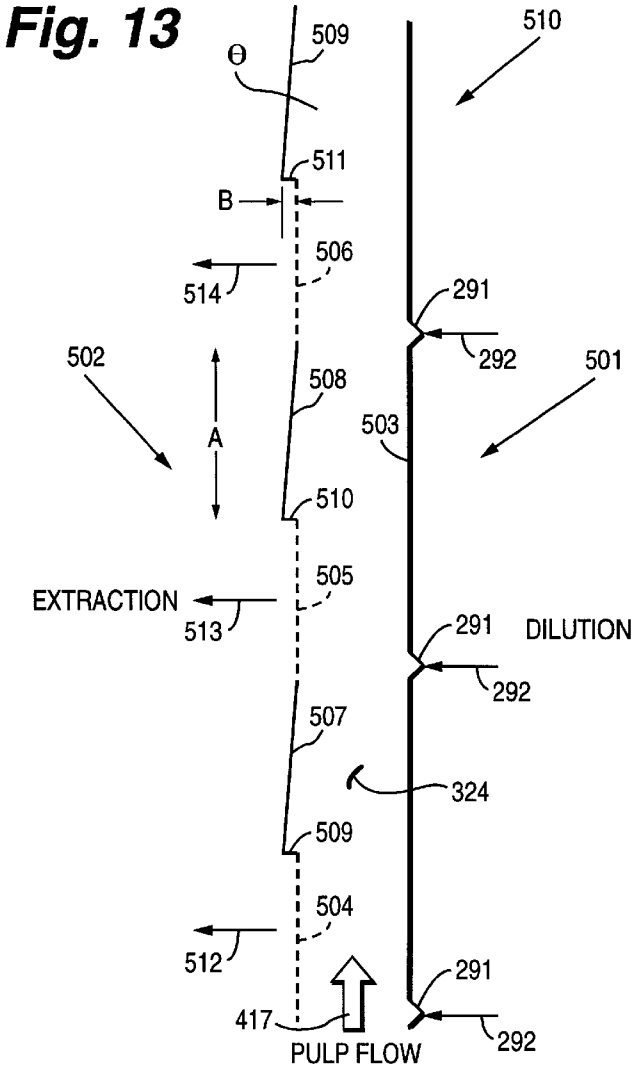
FIG. 13 is a schematic detail view showing operation of one embodiment according to the present invention.
Figure 16:
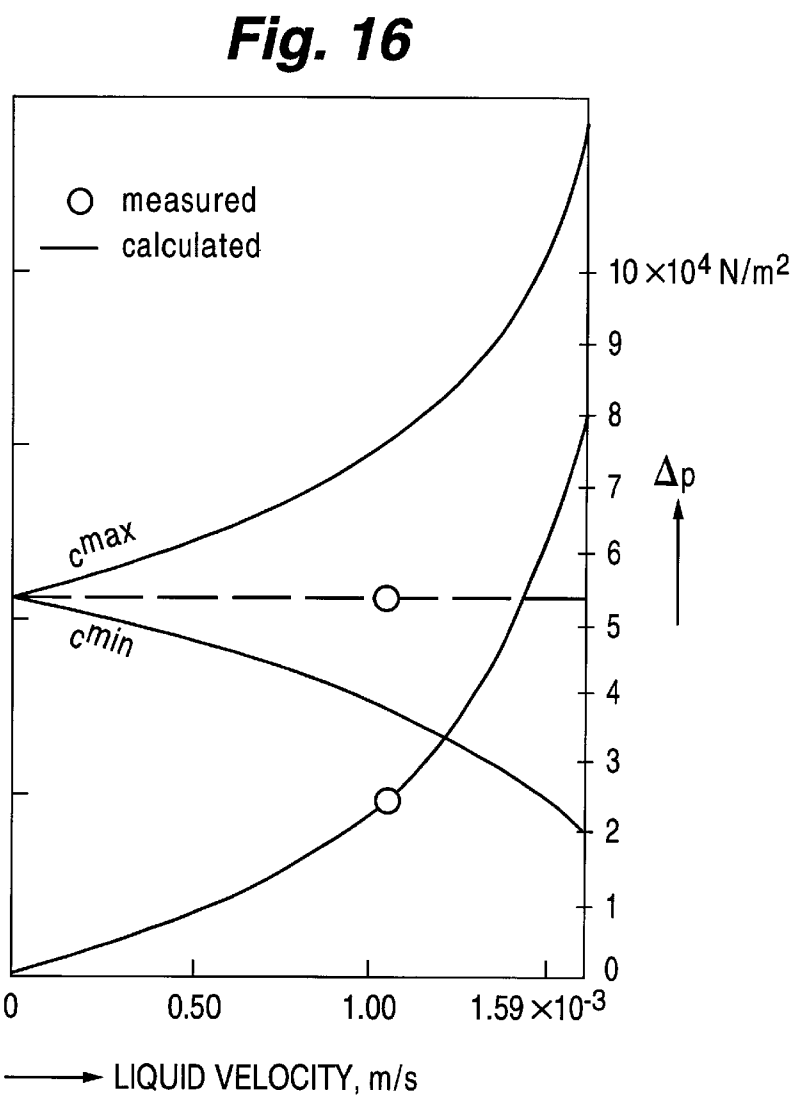
FIG. 16 is a graphical representation showing a typical relationship between liquid velocity and pressure drop across a pulp bed in a pilot scale diffusion washer.
Figure 15:
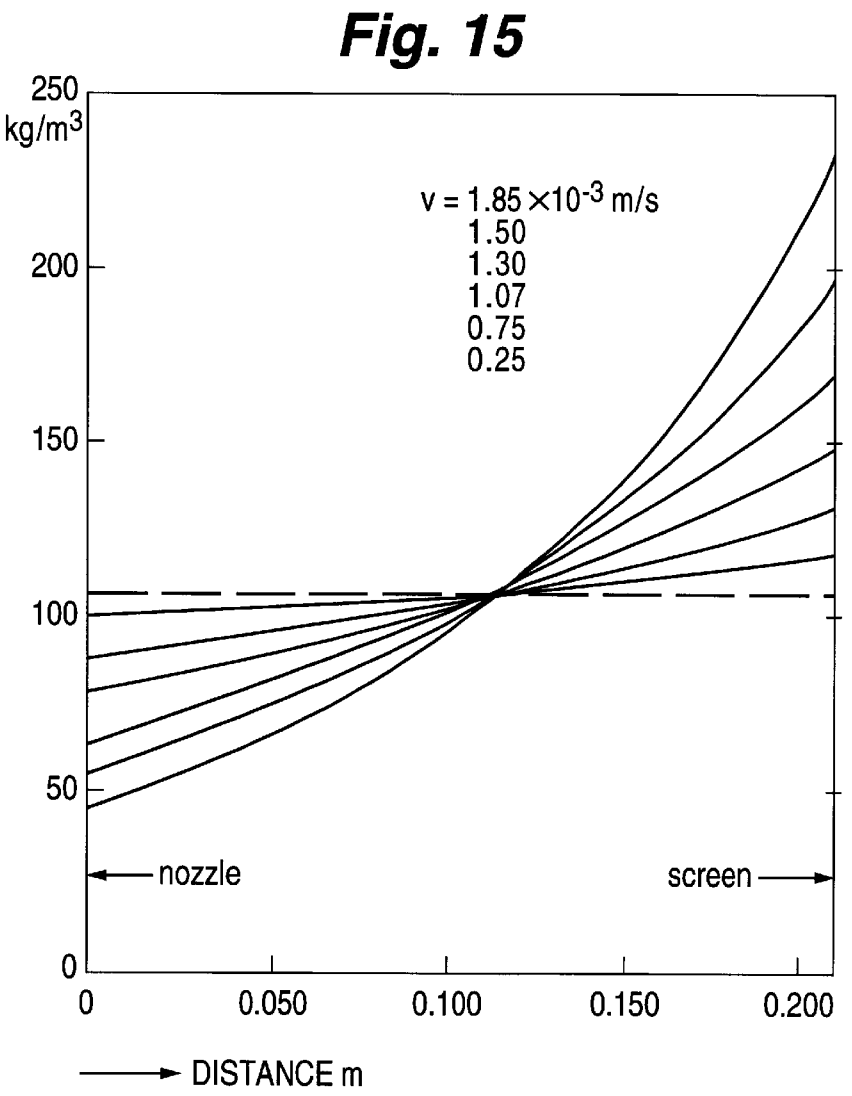
FIG. 15 is a graph plotting location between nozzle and screen versus permeability (in kilograms per meter cubed) for a pilot scale diffusion washer with various liquid flow velocities v.

FIGS. 13 and 14 illustrate a schematic view of a typical cross section of the flow path of the comminuted cellulosic fibrous material through the present invention. This flow path may be present in any of the embodiments disclosed in this specification.

FIG. 13 illustrates a flow path 510 for a flow of a mat of material 324 in a direction shown by arrow 417 between a means for introducing treatment liquid 501 to the mat and a means for removing the treatment liquid 502 from the mat. The flow of liquid in FIG. 13 may be from the outside in or from the inside out. Though the introduction means 501 may be any form of conventional means for introducing a liquid to a mat of material, the preferred means shown is a series of annular distribution openings 291 which are supplied with treatment liquid 292 from a common source (not shown). The internal surface 503 of the means 501 is preferably parallel to the direction of flow 417, that is, surface 503 is a generally right vertical surface since the compressive loads against this surface are relatively less than those on the means for liquid removal 502 and no relaxation zone is necessary. However, as shown in FIG. 14, the surface 503 may also be non-parallel to the direction of flow.

It is to be understood that though in each of the drawing FIGS. the source of liquid to each liquor distribution means is from a common source and the extraction means communicate with a common destination, it is understood that the sources and destinations for these liquids may vary. In particular, a multi-stage operation may be effected by isolating the two or more extraction flows and introducing these two or more extractions as the source of treatment liquid to one or more of liquid distribution conduits. A cleaner supply of treatment liquid may also be introduced as the source of liquid to another liquid distribution conduit, for example, for use as treatment liquid in the first treatment stage.

The means for removing liquid 502 preferably comprises or consists of a series of spaced annular perforated sections 504, 505, and 506 for removing (or extracting) liquid 512, 513, 514 to a common extraction conduit (not shown). These perforated sections may be uniform in length or may vary in length. Again, these perforated sections can be formed from any type of membrane, perforated screen plate, or parallel-plate-type construction through which liquid will pass but comminuted cellulosic fibrous material will not. In the embodiment shown in FIG. 13 these perforated sections are perforated plate or screen plate. The surface of these perforated sections are typically parallel to the direction of material flow 417, that is, they are generally right vertical surfaces. Though parallel, vertical perforated sections are preferred, these perforated sections may also be non-parallel to the direction of flow 417, that is, they may be slanted at an angle of between 0.5 to 15° to the vertical, preferably in a way that expands the flow path.

According to the invention, the perforated sections of means 502 are separated by annular unperforated sections 507, 508, and 509. These unperforated annular sections are typically comprised of metal, typically steel, plate. As in the perforated sections, the unperforated sections may vary in length, A, and may be parallel or non-parallel to the direction of flow 417. In a preferred embodiment shown in FIG. 13, the nonperforated sections are not parallel to the direction of flow but diverge slightly such that the width of the flow path 324 is increased. This increase in flow path during flow past the unperforated sections is desirable since such an increase in flow path width provides a zone where the material mat may relax or decompress and recover at least some of the permeability lost during the treatment adjacent the perforated zones 504, etc. In the preferred embodiment shown in FIG. 13, this increase in flow path is achieved by an abrupt increase in width 509, 510, and 511 above the perforated section. This increase in width, B, typically represents at least about a 5% increase in width of the flow path, preferably, at least a 10% increase or even at least a 15% increase in flow path width (e.g. 15–30%). This increase in width may also vary from one unperforated section 507, etc. to the next. This abrupt increase is typically at least about 0.25 to 2 inches in width.

Furthermore, in the preferred embodiment shown, after the abrupt increase B, the unperforated sections 507, 508, 509, typically gradually conform to the diameter of the unperforated sections 505, 506. That is, in the preferred embodiment of FIG. 13, the unperforated sections 507, 508, 509 typically are slanted at an angle, θ, to the vertical such that these surfaces conform to the diameter of the perforated surfaces above them. The angle θ may vary between 0.5 to 15°, but is preferably between about 2 to 10°.

FIG. 14 illustrates another embodiment of the invention. FIG. 14 is similar in view to the view in FIG. 13 and again may be applied to any of the embodiments of the invention disclosed in this specification. FIG. 14 depicts a flow path 610 for a flow of a mat of material 424 in a direction shown by arrow 517 between a means for introducing treatment liquid 601 to the mat and a means for removing the treatment liquid 602 from the mat. Again, the flow of liquid in FIG. 14 may be from the outside in or from the inside out. Also, again, as in FIG. 13, though the introduction means 601 may be any form of conventional means for introducing a liquid to a mat of material, the preferred means shown is a series of annular distribution openings 391 which are supplied with treatment liquid 392 from a common source (not shown).

Unlike the embodiment shown in FIG. 13, the surface 603 of the means 601 of FIG. 14 is not parallel to the direction of the flow of material 517. In one embodiment the surface 603 of the liquid distribution means 601 increases abruptly in the vicinity of the annular distribution openings 391 by a width B1. Then, after treatment liquid is introduced at 391, the surface 604 of means 601 gradually tapers at an angle β to conform again to the diameter of the right vertical surface 603. The angle β like the angle θ in FIG. 13 may vary between 0.5 to 15°, but is preferably between about 2 to 10°.

As also shown in FIG. 14, the surface 603 may also be non-parallel as shown in phantom by surface 603', which is oriented at angle similar to β. That is, the diameter of the surface of the liquid introduction means 601 may vary from a maximum at the point of liquid introduction 391 to a minimum at a point 605 between the points of liquid introduction such that the surface 603 has a "wash board" appearance.

The liquid removal (or extraction) means 602 shown in FIG. 14 is essentially identical to the means 502 shown in FIG. 13. This includes alternating perforated sections 606 and nonperforated sections 607, abrupt increases in bed width 608, and liquid removal 609 to a common conduit (not shown).

Figure 21:
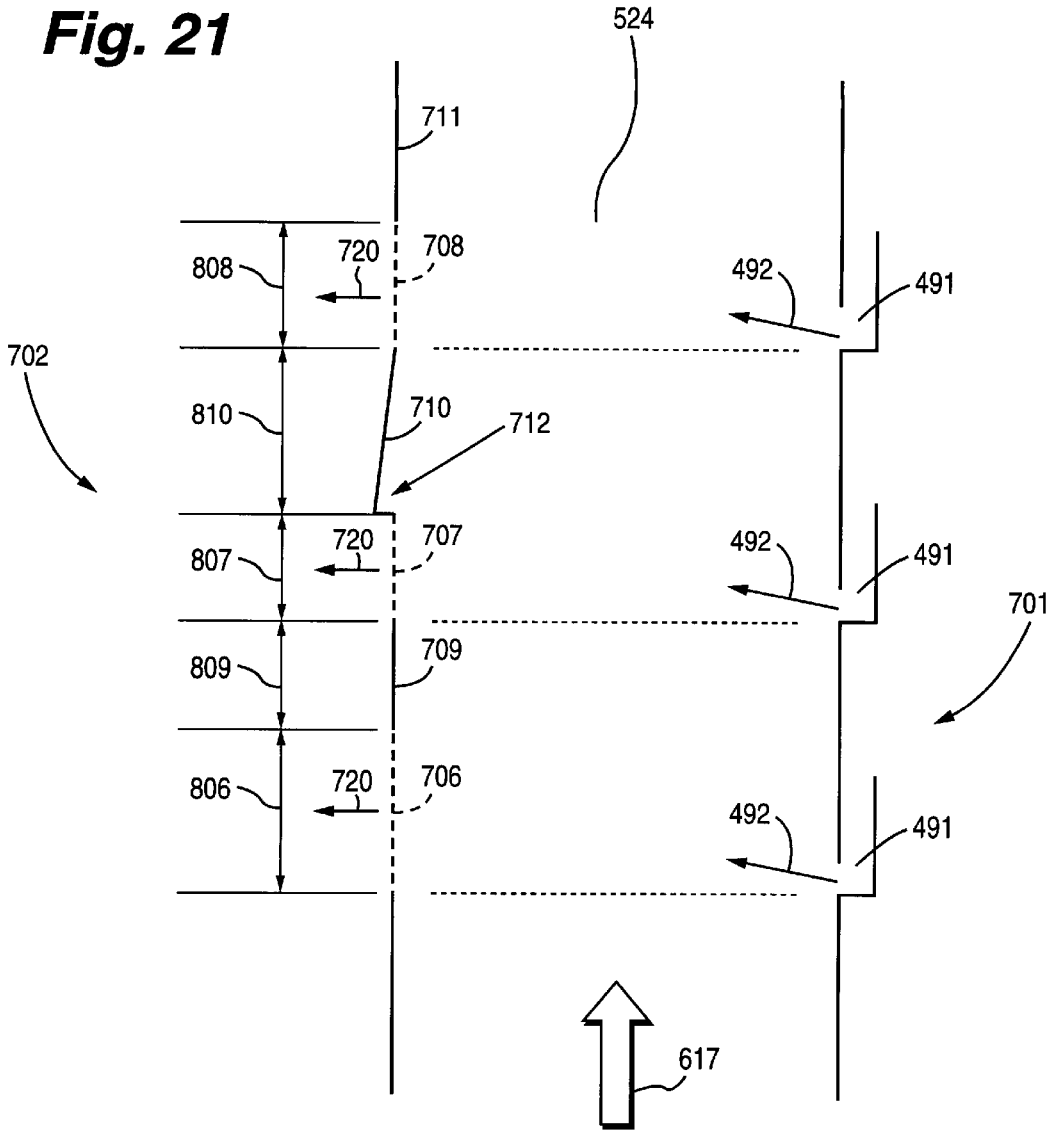
FIG. 21 is a schematic detail side view of another exemplary embodiment of a vessel according to the present invention taken along lines 21—21 of FIG. 22.
Figure 22:
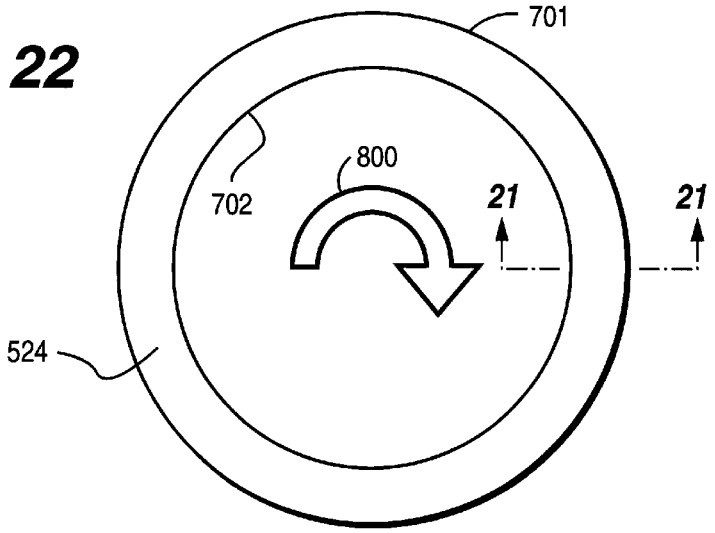
FIG. 22 is a schematic top view of a vessel having the configuration of FIG. 21 and schematically illustrating rotation of the screen surface therein.

FIG. 21 illustrates another embodiment of this invention that incorporates some of the means for controlling material permeability discussed earlier. Similar to FIGS. 13 and 14, FIG. 21 illustrates a flow path that can be used in any of the embodiments of the present invention, for example, the flow path of FIG. 21 can be used in a circular device shown in FIG. 22. (FIG. 22 illustrates a top view, as was shown in FIG. 3, of a circular embodiment of the invention.) For example, FIG. 21 may represent the sectional view 21—21 of FIG. 22.

Similar to FIGS. 13 and 14, FIG. 21 illustrates a flow path 524 for material flowing in the direction of arrow 617 between a means for supplying treatment liquid to the material 701 and a means for removing treatment liquid from the materiel 702. The means for supplying treatment liquid 701 comprises or consists of a series of vertically-spaced annular baffle openings 491 for introducing treatment liquid 492 to the mat of material 524.

Also similar to FIGS. 13 and 14, the means for removing or extracting liquid from the material 702 in FIG. 21 comprises or consists of a series of vertically spaced perforated regions 706, 707, 708, separated by unperforated regions 709, 710, 711, for removing liquid 720. The structure of the perforated and unperforated regions are as described earlier. However, unlike the earlier embodiments, the invention disclosed in FIG. 21 illustrates one method of varying the liquor removing means to minimize the impact of the reduction in permeability that characterized conventional diffusion-type devices. For instance, the lowest perforated region 706 has a height 806 based upon the compressibility of the material treated, the width of the flow path 524, and the viscosity of the treatment liquid 492, among other things. That is, the characteristics of the material being treated and the treatment liquid determine when the mat of material will be sufficiently compressed so that little of no flow can pass through the mat and, thus, where the removal of the liquid should be terminated. In this case, the liquid removal is terminated at the top of perforated region 706.

After passing region 706, the mat of material passes unperforated region 709, where, since no liquid is being removed which would further compress the mat, the mat is allowed to relax or decompress and recover some of the permeability lost during treatment adjacent to perforated region 706. According to the present invention, by the time the mat of material travels the length 809 of region 709 and encounters the next perforated region 707, the permeability of the mat of material has sufficiently recovered such that the treatment liquid can be efficiently removed via perforated region, or screen, 707. However, further according to this invention, the length of screen 707, that is, 807 is so designed such that, again, the permeability of the mat is not excessively reduced while liquid is removed from the mat adjacent screen 707. Note that the length 807 of screen 707 may be shorter than the length 806 of screen 706 since the material passing screen 707 has been compressed, and the permeability reduced, previously during treatment adjacent to screen 706.

After passing screen 707, the material being compressed and having a reduced permeability, the mat of material encounters unperforated region, or plate, 710. Plate 710 may simply be a vertical plate similar to plate 709. However, the compression of the mat after passing screen 707 may be excessive enough that simply terminating liquid removal from the mat is insufficient to decompress and recover the permeability lost during treatment adjacent screen 707. In the embodiment shown in FIG. 21, after passing screen 707, the width of the flow path is increased abruptly at 712 to promote the decompression of the mat and the recovery of permeability. The width of the flow path is then gradually decreased along the length 810 of plate 710 prior to encountering the next screen 708. As an alternative, the increase in bed width at 712 may also be maintained such that plate 710 is non-converging and the subsequent treatment at screen 708, and subsequent treatments, is performed with the wider width, or the width of the bed may be increased even further.

Depending upon the degree of relaxation of the pulp mat upon passing screen 708, the length 808 of this screen may be longer or shorter than the length 807 of screen 707. After passing screen 708 the liquid removal is again terminated at unperforated plate 711 before proceeding to further treatment or discharge from the vessel.

The flow path geometry and plate lengths shown in FIG. 21 represent one of many embodiments that can be used to effect the present invention. Other configurations, dimensions, orientations, etc. can also be used depending upon the material treated and the treatment liquid, among other things.

The geometry of the liquid removal means 702 is designed to minimize the compression and loss of permeability of the pulp bed so that each perforated region is used as effectively as possible. Over compression of the material mat and loss of liquid flow is avoided by designing the means for liquid removal based upon the compressibility and flow characteristics of the material being treated. In this way, compared to conventional diffusion type treatment devices, as much of the available perforated area is used as possible and a more efficient treatment is achieved.

FIG. 22 also illustrates one other preferred embodiment of this invention. As discussed earlier, it is desirable to somehow at least intermittently move the surface of the perforated screen section relative to the surface of the material mat during treatment in order to prevent pluggage of the screen. It has been discovered that the resistance to movement of the screen relative to the material is markedly lower if the screen is moved in a direction perpendicular to the direction of flow of the material. The force of resistance may by at least 25% less, possibly at least 50% less, than the force required to move the screen surface in the same or opposite direction of the material movement, as is done in conventional diffusion-type washers. Though this movement of the screen in a direction substantially perpendicular to the direction of material flow is application to any shape of screen, one preferred method of doing this is shown in FIG. 22 for the circular-type device.

In FIG. 22, the liquor removal means 702 is suspended within the stationary vessel and liquid addition means 701. In a preferred embodiment of this invention, the liquor removal means 702, for example, an extraction chamber, is rotated relative to the pulp bed 524 as shown by arrow 800 to reduce the friction load and the compression of the material adjacent the screen. This rotation may be of relatively short distance, for example, a rotation of less than 30 degrees, e.g. 10–25 degrees. Attentively this movement may even be a vibration or oscillation in the circumferential direction. To effect rotation, any conventional means capable of doing that may be utilized, such as a motor mounted above or in the vessel. The vibration or oscillation may also be performed by any conventional means, such as a vibrator or oscillator mounted interiorly of the screen surface. The screen surface may be sequential, with the segments mounted for relative movement with respect to each other, to facilitate this movement.

Figure 23:
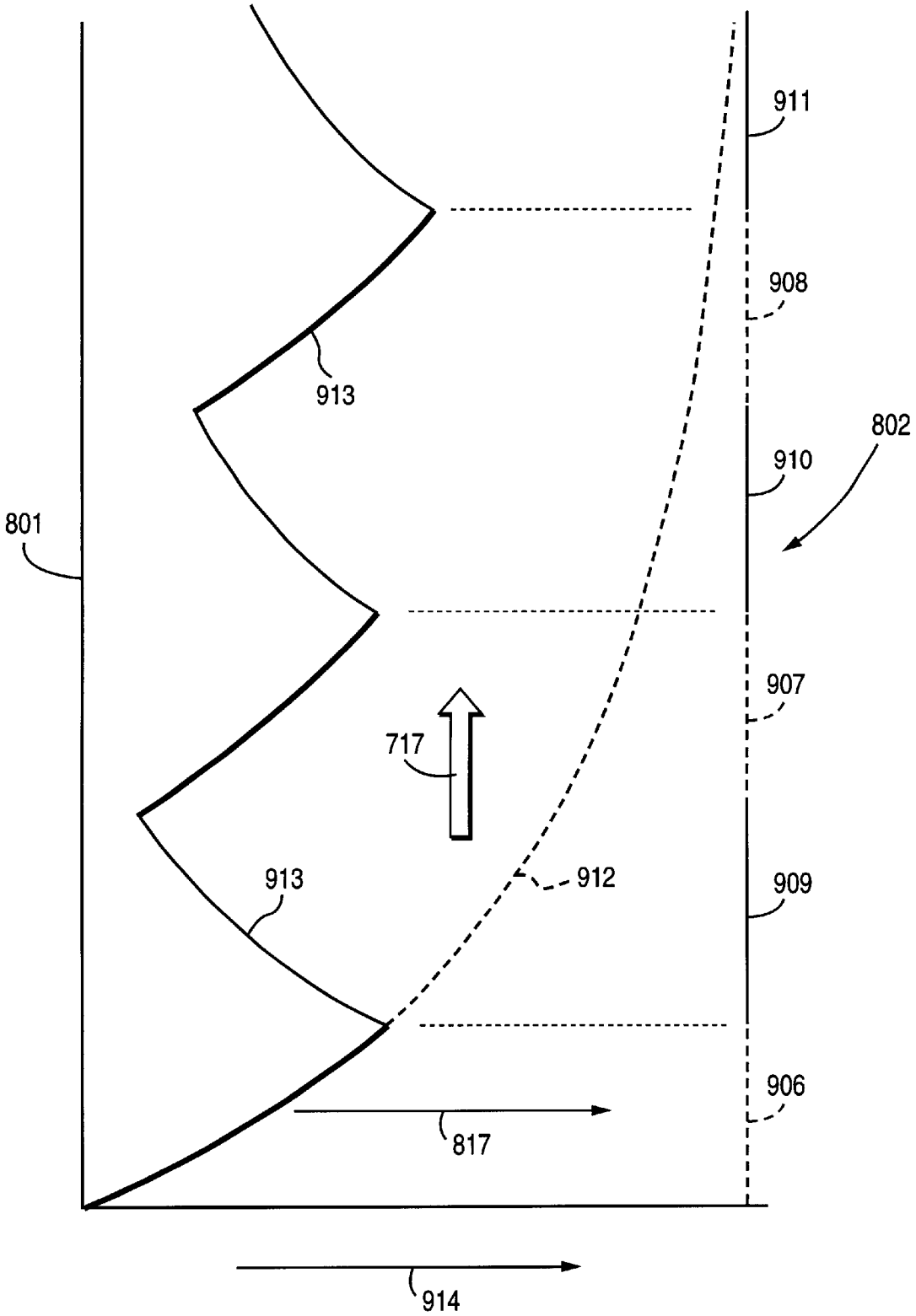
FIG. 23 is a schematic graphical representation of the differences between the invention and a conventional diffuser.

FIG. 23 illustrates the some of the theoretical improvements of the present invention compared to conventional diffuser-type treatment devices. FIG. 23 shows a schematic representation of a means for introducing treatment liquid to the pulp 801 and a means for extracting liquid from the pulp 802, for example, any of the means disclosed above. The pulp flows in the direction of arrow 717 and the treatment liquid flows in the general direction of arrow 817. The means 802 comprises or consists of a series of extraction screens 906, 907, and 908, separated by non-perforated plates 909, 910, and 911.

The horizontal axis of FIG. 23 represents the value of one or more of the following variables: pressure drop through the bed, friction load on the screen, the local consistency of the pulp, the inverse of the permeability of the bed, or the inverse of the bed strength. An increase in these values is represented by arrow 914.

Curve 912 represents the variation of these variables in a conventional diffusion-type treatment device having a single location where treatment liquid is introduced, for example, at lower-most level of means 801, and a continuous, uninterrupted, vertical screen plate for the means 802. In the conventional system, as the liquid flows in the direction 807 and the pulp bed rises in the direction or arrow 717, the pressure drop, friction load, consistency, inverse of permeability, and inverse of the strength all increase asymptotically as shown by curve 912.

However, when the present invention is used these parameters behave as shown by curve 913. That is, these values rise initially in much the same manner as in the conventional system while liquid is removed via screen 906; however, when the pulp mat encounters plate 909 and the extraction flow is terminated, these values fall as shown since no liquid is being removed. These values again increase when the pulp reaches screen 907, but again fall when plate 910 is reached. Similar behavior is seen at screen 908 and plate 911.

Thus, unlike the conventional diffusion-type washers, according to the present invention, the pressure drop, friction load, consistency, inverse of the permeability and inverse of the bed strength are all controlled to limit their negative impact upon the efficiency of the treatment performed.

The following calculations illustrate typical design parameters that must be considered when designing diffusion-type treatment devices.

The permeability of a bed of pulp 24, 124 is given by Darcy's law as expressed in the following differential equation $$\frac{dp}{dn} = \frac{v}{G_0}\frac{\mu}{\mu_0} \qquad \text{Equation 1}$$

In this equation, $$\frac{dp}{dn} =$$

the permeability of the pulp bed, that is, pressure drop dp per unit bed thickness dn in pounds per square foot per foot [#/ft$^2$/ft].

v=the superficial fluid velocity in feet per second [ft/s].

Figure 20:
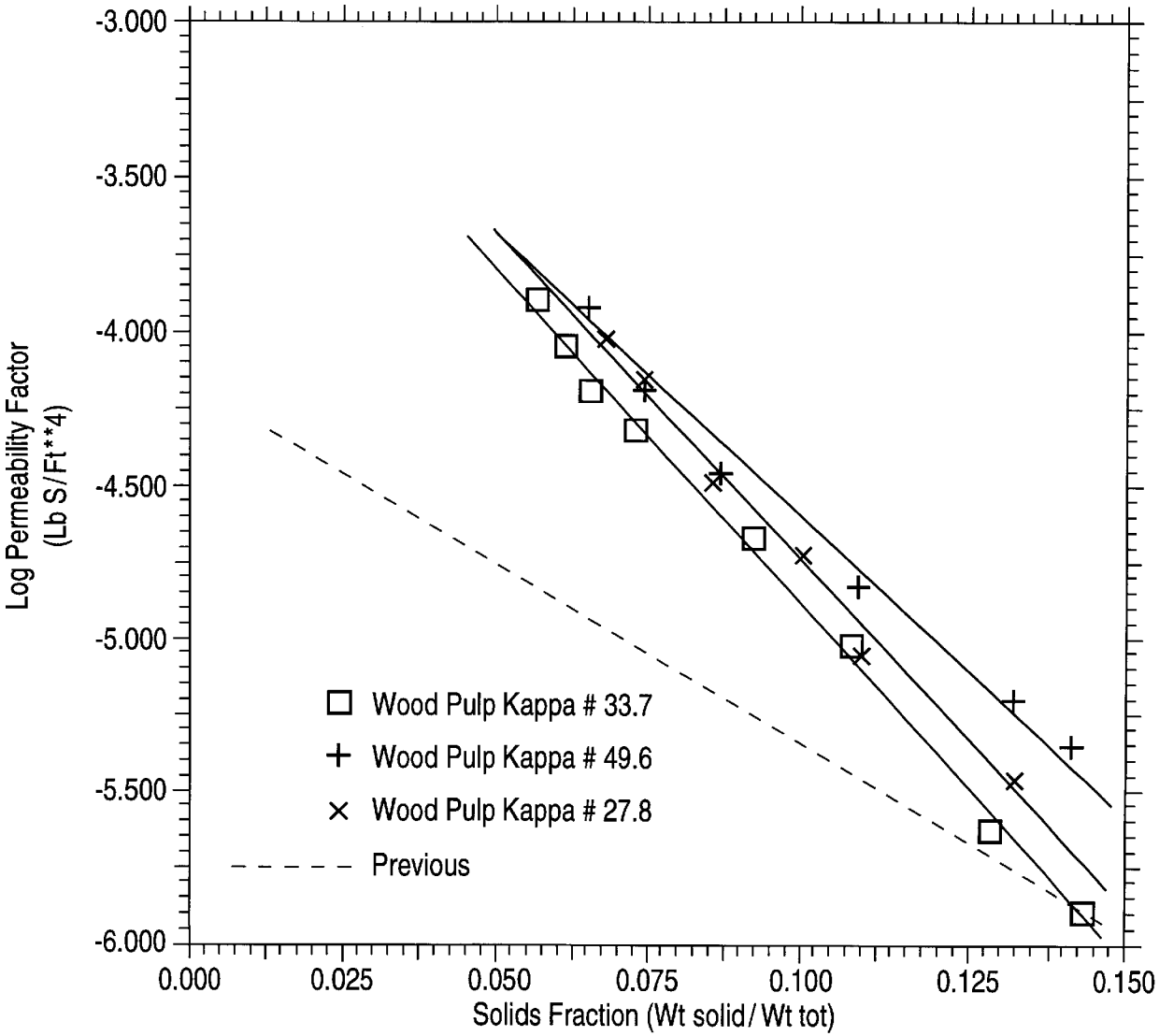
FIG. 20 showing a plot of consistency (also known as solids fraction) versus the log of a permeability factor of wood pulp at three different kappa numbers.

$G_o$=the permeability factor, obtained from FIG. 20 for a given pulp consistency in pounds per cubic foot per foot per second [# s/ft$^3$].

$\mu$=the viscosity of the liquid in centipoise [cp] at given temperature.

$\mu_0$ =reference liquid viscosity at 70° F.=1.5 cp.

The following calculations assume a liquid temperature of 180°, a liquid velocity of $3.3\times10^{-3}$ ft/s, and a pulp consistency ranging from 10 to 13%. The corresponding viscosity, $\mu$, at 180° F. is 0.96 cp. From FIG. 20 the approximate permeability factor, $G_0$, for the given range of consistencies are listed in Table 2.

TABLE 2

PERMEABILITY FACTORS FROM FIG. 20

| Consistency[%] | Log $G_0$ | $G_0$ [# s/ft$^4$] |
|---|---|---|
| 10 | −4.75 | 0.00001778 |
| 11 | −5.00 | 0.00001000 |
| 12 | −5.35 | 0.00000447 |
| 13 | −5.50 | 0.00000316 |

Substituting these values for v, $G_0$, $\mu$, $\mu_0$, and a typical pulp bed width 23 of ten inches into equation 1 yields the pressure drop, dp, across the bed shown in Table 3.

TABLE 3

PRESSURE DROPS ACROSS PULP BED

| Consistency[%] | dp/dn,#/ft$^2$/ft | dp, #/ft$^2$, for dn = 10 inch bed width |
|---|---|---|
| 10 | 118.6 | 98.8 |
| 11 | 211.2 | 176.0 |
| 12 | 472.5 | 393.7 |
| 13 | 668.4 | 557.0 |

The typical screen area per tonnage ratio for a 10% consistency pulp treated using a typical dilution factor, DF, of 2.0 is about 1.24 $ft^2$/BDTD [or Bone-Dry Tons per Day]. Assuming a nominal production rate or 100 BDTD, the above ratio yields a screen area of 124 $ft^2$. Applying the pressures dp of Table 3 over this area yields a normal load on the screen shown in Table 4.

TABLE 4

NORMAL LOAD ON SCREEN AND FRICTION FORCE

| Consistency[%] | Load, tons | Friction, tons. |
|---|---|---|
| 10 | 6.1 | 3.0 |
| 11 | 10.9 | 5.45 |
| 12 | 24.4 | 12.2 |
| 13 | 34.5 | 17.3 |

When the screen 14 is moved relative to the pulp bed, for example, by downstroking or via vibration, the normal load shown in Table 4, produces a friction force between the pulp bed 24, 124 and the screen 22 surface. If a 0.5 coefficient of friction is assumed, the friction force for the specified screen normal load also appears in Table 4.

Figure 17:
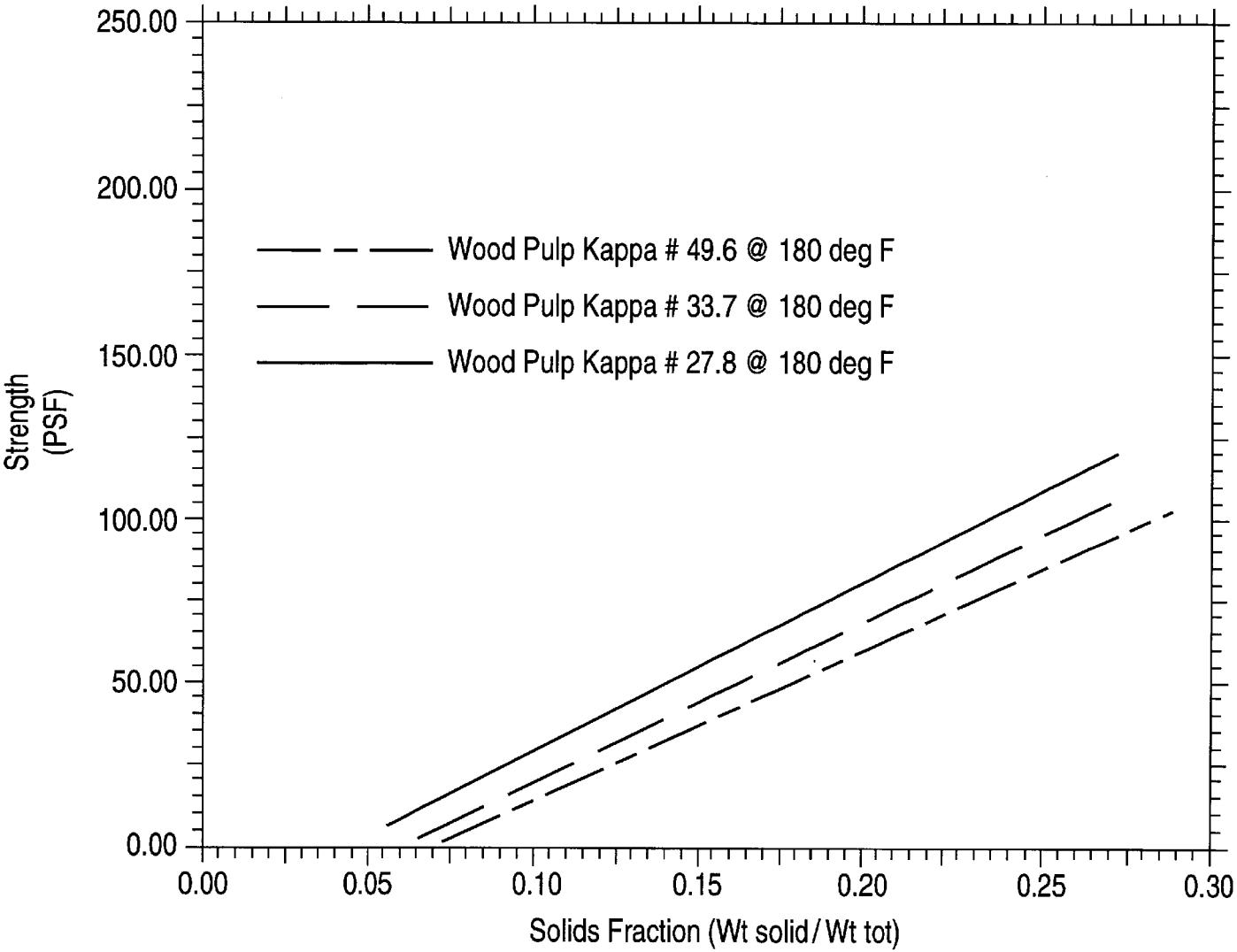
FIG. 17 is a graph plotting pulp bed strength versus consistency (also known as "solids fraction" in conventional pulp beds)

The friction force shown in Table 4 is not only the friction force on the screen 22 but it is also the force on the pulp. As discussed above, one consideration when designing diffusion-type washing devices is the load on the pulp bed 24, 124 and the minimization of the disruption of this load on the integrity of the bed—again, disruption of the bed is undesirable in a diffusion-type process. Thus, to operate effectively, the pulp bed must be "strong enough" to withstand the loading imposed on it by the friction force shown in Table 4. Based upon the geometry of the pulp, among other things, the friction forces shown in Table 4 can be used to determine the stresses in the pulp bed. These stresses can be compared to the predetermined strength of the bed, that is, the maximum load that can be withstood by the pulp bed without failure by shearing, as shown in FIG. 17, to determine whether the pulp bed can withstand the friction load without shearing. Shear failure of the bed can be prevented by limiting the compression of the bed, and the consequence increase in screen friction, by employing the method and apparatus of the present invention.

As discussed above, one of the principal features of the present invention is to limit the decrease in permeability that characterizes existing diffusion-type washers. As also noted above, the permeability of the bed of pulp will vary from a relatively higher permeability at the point where treatment liquid is introduced to a relatively low permeability at the point where the liquid is removed or extracted, for example, at the extraction screen plate. For a typical application according to this invention, the pulp slurry will be introduced to the treatment zone at a solids consistency of about 10%. Adjacent the point of introduction of treatment liquid the diluting effect of this liquid will reduce the local solids consistency to about 8%. As the liquid is drawn across the pulp mat and withdrawn from the pulp, the pulp mat will typically be compressed to a consistency of at least about 12% at the point of extraction. Thus, the variation in consistency across the pulp mat will typically vary from about 8% to about 12%, possibly to about 14% or more.

As was discussed above in relation to Tables 1 through 4, the pulp consistency and liquid viscosity will, by Darcy's Law shown in Equation 1, determine the permeability, dp/dn, of the local pulp mat. Assuming the same conditions used in the earlier calculations, that is, $v=3.30\times10^{-3}$ ft/s; $\ddot{y}=0.96$ cp at a liquid temperature of 180; and $\ddot{y}_0=1.5$, Table 5 summarizes the evaluation of Equation 1 for consistencies of 8, 10, 12, and 14%.

TABLE 5

TYPICAL VARIATION IN PERMEABILITY

| Consistency [%] | Log $G_0$ [from FIG. 20] | $G_0$ [# s/$ft^4$] | dp/dn [#/$ft^2$/ft] |
|---|---|---|---|
| 8 | −4.25 | .00005623 | 37.56 |
| 10 | −4.75 | .00001000 | 118.6 |
| 12 | −5.35 | .00000447 | 472.5 |
| 14 | −5.75 | .00000179 | 1180.0 |

Clearly, as the consistency increases the pressure drop across a layer of pulp consistency increases, or the permeability of the bed decreases. That is, the term "permeability" refers to the inverse of the value of dp/dn. A decrease in permeability to an increase in the value of dp/dn.

According to the present invention, the pulp characteristics are limited to limit the decrease permeability. This can be achieved by either limiting the value of dp/dn in the pulp mat or, in effectively the same manner, limiting the increase in consistency of the pulp mat. According to the present invention, the consistency of the pulp being treated is limited to maximum to limit the decrease in permeability. The maximum local consistency according to the present invention is limited to a value that is less than 18%, preferably less than 16%, most preferably, less than 14%. The present invention also comprises consists of a method which limits the variation in consistency throughout the bed to range of consistency in the treatment zone that is not greater than 10%, preferably, not greater than 8%, most preferably, not greater than 6%, for example, 14%–8%=6%.

In another embodiment of this invention, the value of dp/dn within a bed of pulp is preferably limited to a maximum of about 1000 pounds per square foot per foot [#/$ft^2$/ft], more preferably, to a maximum of about 750 #/$ft^2$/ft, or even 500 #/$ft^2$/ft. Also, the present invention is characterized by limiting the variation of dpldn to a difference of less than 1000 #/$ft^2$/ft across the pulp bed, preferably, less than 600 #/$ft^2$/ft, most preferably, less than 400 #/$ft^2$/ft.

Throughout the application all narrow ranges within a broad range are specifically included herein. For example a consistency range of 8–14% means 8–12%, 8–11%, 9–13%, and all other narrower ranges.

It will thus be seen that according to the present invention a method and apparatus are provided which substantially overcomes the washing inefficiencies that are due to variation in pulp bed permeability that are characteristic of prior art diffusion washers. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A diffusion assembly for treating a liquid slurry of solid material, said assembly comprising:

a substantially upright vessel have a non-circular cross-section, defined by a vessel wall, for at least a treatment portion thereof, said treatment portion between an inlet and an outlet for liquid slurry;

at least one screen surface for removing some of the liquid of the liquid slurry from said treatment portion of said vessel, but minimal solids slurried by the liquid; and said vessel and said at least one screen surface, constructed and positioned with respect to each other so that during treatment the liquid slurry has a substantially uniform width in said treatment portion and there is substantially uniform resistance to the flow of slurry over said screen surface over any particular cross-section of said vessel in said treatment portion.

2. An assembly as recited in claim 1 wherein said vessel has a substantially race track shape in cross-section at said treatment portion.

3. An assembly as recited in claim 2 further comprising treatment liquid introducing means mounted interiorly of said vessel treatment portion, and wherein said screen surface is operatively mounted in or with said vessel wall.

4. An assembly as recited in claim 3 wherein said screen surface comprises a plurality of substantially annular screen elements vertically spaced from each other along said vessel treatment portion, and wherein said liquid introducing means comprises a plurality of vertically spaced liquid introducing structures, substantially in vertical alignment with said substantially annular screen elements.

5. An assembly as recited in claim 1 wherein said screen surface is mounted interiorly of said vessel treatment portion, and further comprising treatment liquid introducing means operatively mounted in or with said vessel wall for introducing treatment liquid into the slurry in said vessel treatment portion.

6. An assembly as recited in claim 5 wherein said screen surface is substantially vertical, and comprises screening portions vertically spaced by non-screening portions.

7. An assembly as recited in claim 6 wherein said vessel wall bulges out substantially at the location of said non-screening portions so as to provide a slurry width thereat at least 5% wider than at said screening portions associated therewith.

8. An assembly as recited in claim 5 wherein said screen surface is mounted interiorly of said vessel by a plurality of hollow supports which both support said screen surface and remove liquid which passes through said support surface from said vessel; and further comprising means for moving said screen surface at spaced points in time so as to substantially prevent plugging of said screen surface.

9. An assembly as recited in claim 5 wherein said vessel inlet is at the bottom thereof, and said vessel outlet is at the top thereof.

10. An assembly as recited in claim 9 further comprising a one-dimensional convergence and side relief structure directly connected to or forming at least part of said outlet.

11. An assembly as recited in claim 1 further comprising treatment liquid introducing means associated with said treatment portion of said vessel; and wherein said vessel, liquid introducing means, and at least one screen surface, are constructed and positioned with respect to each other so that the permeability of a slurry bed in said treatment portion is a maximum of about 750 pounds per square foot per foot.

12. An assembly as recited in claim 1 wherein the vessel is a substantially atmospheric pressure vessel, and wherein said slurry width forms an annulus in said vessel, and said annulus is substantially uninterrupted in said treatment portion.

13. An assembly as recited in claim 12 further comprising treatment liquid introducing means associated with said treatment portion of said vessel; and wherein said vessel, liquid introducing means, and at least one screen surface, are constructed and positioned with respect to each other so that the permeability of a slurry bed in said treatment portion is a maximum of about 1,000 pounds per square foot per foot.

14. An assembly as recited in claim 1 in combination with a plurality of like vessels, and an exterior vessel, said exterior vessel mounting said plurality of like vessels therein.

15. A method of treating a slurry of compressible comminuted cellulosic fibrous material, having a permeability that varies as it is compressed, in a treatment zone, comprising:

(a) introducing a flow of the slurry into the treatment zone to form a bed of slurry having a first side and a second side, and a width;

(b) passing the slurry through the treatment zone;

(c) in the treatment zone introducing a treatment liquid into the bed at the first side thereof so that the liquid passes from the first side through to the second side thereof;

(d) removing at least some of the liquid from the second side of the bed; and wherein (a)–(d) are practiced so that the permeability of the slurry bed in the treatment zone is a maximum of about 750 lbs./ft.$^2$/ft.

16. A method as recited in claim 15 wherein (b) is practiced substantially without disrupting the flow of slurry, and wherein (a)–(d) are practiced at substantially atmospheric pressure.

17. A method as recited in claim 16 wherein (a)–(d) are further practiced with a slurry having a consistency throughout the treatment zone of between about 8–16%, and with a difference in consistency in the treatment zone of less than about 6%.

18. A method as recited in claim 17 wherein (c) and (d) are not practiced at spaced locations as the slurry moves through the treatment zone.

19. A method as recited in claim 18 wherein said method further comprises increasing the width of the slurry bed at the spaced locations where (c) and (d) are not practiced, to allow said slurry to recover substantially its permeability before (c).

20. A method as recited in claim 15 wherein (a) and (c) are practiced in substantially vertical paths and (c) in a substantially horizontal path; and wherein (c) and (d) are not practiced at spaced locations as the slurry moves through the treatment zone, and wherein (a)–(d) are practiced utilizing a screen surface at the second side thereof; and further comprising occasionally moving the screen surface in a direction or manner distinct from the direction of flow of slurry through the treatment zone so as to minimize plugging thereof, by rotating the screen surface about an axis substantially parallel to the direction of slurry flow through the treatment zone of less than 30 degrees, or by vibrating or oscillating the screen surface in a direction substantially transverse to the direction of flow of slurry through the treatment zone.

21. A method as recited in claim 20 wherein said method further comprises increasing the width of the slurry bed at the spaced locations where (c) and (d) are not practiced, to allow said slurry to recover permeability.

22. A method as recited in claim 15 wherein (a)–(d) are practiced to establish a plurality of substantially parallel beds of slurry and treatment zones, and to treat slurry in all of said plurality of beds and treatment zones at substantially the same time; and further comprising combining said plurality of beds after treatment thereof.

23. A method as recited in claim 15 wherein (c) is practiced using a wash liquid to effect washing of the material of the slurry.

24. A diffusion assembly for treating a liquid slurry of comminuted cellulosic fibrous material, each assembly comprising:

a substantially upright vessel having a non-circular cross-section, defined by a vessel wall, for at least a treatment portion thereof between an inlet and outlet;

at least one screen surface which removes some of the liquid of the comminuted cellulosic fibrous material slurry from the treatment portion of the vessel; and said vessel and said at least one screen surface constructed and positioned with respect to each other so that during treatment the slurry has a substantially uniform width in said treatment portion and so that the permeability of the slurry in said treatment portion is a maximum of about 750 pounds per square foot per foot.

25. An assembly as recited in claim 24 further comprising treatment liquid introducing devices associated with said treatment portion which introduce liquid into said treatment portion including so that the permeability of the slurry in said treatment portion is a maximum of about 750 pounds per square foot per foot.

26. An assembly as recited in claim 25 wherein said vessel has a substantially race track shape in cross-section at said treatment portion.

27. An assembly as recited in claim 25 wherein said screen surface comprises screening portions vertically spaced by non-screening portions; and wherein said vessel wall bulges our substantially at the location of said non-screening portions so as to provide a slurry width thereat at least 5% wider than at said screening portions associated therewith.

28. An assembly as recited in claim 24 wherein said vessel has a substantially race track shape in cross-section at said treatment portion.

29. An assembly as recited in claim 24 wherein said screen surface comprises screening portions vertically spaced by non-screening portions; and wherein said vessel wall bulges our substantially at the location of said non-screening portions so as to provide a slurry width thereat at least 5% wider than at said screening portions associated therewith.

30. An assembly as recited in claim 29 wherein said vessel has a substantially race track shape in cross-section at said treatment portion.

31. An assembly as recited in claim 29 wherein said screen surface comprises screening portions vertically spaced by non-screening portions; and wherein said vessel wall bulges our substantially at the location of said non-screening portions so as to provide a slurry width thereat at least 5% wider than at said screening portions associated therewith.

* * * * *